US005814436A

United States Patent [19]

Ishikawa

[11] Patent Number: 5,814,436

[45] Date of Patent: Sep. 29, 1998

[54] METHOD FOR THE PROCESSING OF SILVER HALIDE COLOR PHOTOGRAPHIC MATERIAL

[75] Inventor: Takatoshi Ishikawa, Kanagawa, Japan

[73] Assignee: Fuji Photo Film Co., Ltd., Kanagawa, Japan

[21] Appl. No.: 863,931

[22] Filed: May 27, 1997

Related U.S. Application Data

[63] Continuation of Ser. No. 362,931, Dec. 23, 1994, abandoned.

[30] Foreign Application Priority Data

Dec. 24, 1993 [JP] Japan ..... 5-345918

[51] Int. Cl.[6] ..... G03C 7/00; G03C 5/44; G03C 5/42; G03C 1/005

[52] U.S. Cl. ..... 430/393; 430/430; 430/461; 430/567; 430/581; 430/600; 430/603; 430/605; 430/943

[58] Field of Search ..... 430/393, 430, 430/461, 567, 943, 581, 600, 603, 605

[56] References Cited

U.S. PATENT DOCUMENTS

| | | | |
|---|---|---|---|
| 4,459,217 | 7/1984 | Bogie | 252/99 |
| 4,704,233 | 11/1987 | Hartman et al. | 252/527 |
| 4,952,490 | 8/1990 | Takada et al. | 430/567 |
| 4,983,315 | 1/1991 | Glogowski et al. | 252/102 |
| 5,149,618 | 9/1992 | Tappe et al. | 430/393 |
| 5,238,791 | 8/1993 | Tappe et al. | 430/393 |
| 5,264,337 | 11/1993 | Maskasky | 430/567 |
| 5,266,450 | 11/1993 | Takehara | 430/567 |
| 5,275,930 | 1/1994 | Maskasky | 430/567 |
| 5,292,632 | 3/1994 | Maskasky | 430/567 |
| 5,316,898 | 5/1994 | Ueda et al. | 430/393 |
| 5,320,938 | 6/1994 | House et al. | 430/567 |
| 5,356,764 | 10/1994 | Szajewski et al. | 430/567 |
| 5,364,750 | 11/1994 | Yoshida et al. | 430/567 |
| 5,391,466 | 2/1995 | Ueda et al. | 430/393 |
| 5,405,739 | 4/1995 | Ohya et al. | 430/600 |
| 5,413,904 | 5/1995 | Chang et al. | 430/567 |
| 5,420,001 | 5/1995 | Ito et al. | 430/567 |
| 5,580,705 | 12/1996 | Ueda et al. | 430/461 |
| 5,635,341 | 6/1997 | Yamashita et al. | 430/461 |
| 5,679,501 | 10/1997 | Seki et al. | 430/393 |
| 5,695,915 | 12/1997 | Ueda et al. | 430/393 |
| 5,707,787 | 1/1998 | Kuwae et al. | 430/393 |

FOREIGN PATENT DOCUMENTS

| | | | |
|---|---|---|---|
| 0053495 | 6/1982 | European Pat. Off. . | |
| 0532003 | 3/1993 | European Pat. Off. . | |
| 61-235837 | 10/1986 | Japan | 430/393 |
| 63-212932 | 9/1988 | Japan . | |
| 5-72695 | 3/1993 | Japan . | |
| 1043137 | 9/1983 | U.S.S.R. . | |

OTHER PUBLICATIONS

J. Majer et al, New Compfesanes. VIII. Ethylenediamino–N, N'–Disuccinic Acid and Investigation of Its Heavy Metal Complexes by Spectrophotometry. *Chem. Zvesti* 20(6) pp. 414–422 (1966).

J. Neal et al., Stereospecific Ligands and Their Complexes I. A. Cobalz (III) Complex of Ethylenediaminedisuccinic acid. *Inorg. Chem.* 7, pp. 2405–2412 (1968).

K. Ueno, "Chelase Chemistry", vol. 5, Section 1, pp. 309, 311, 324.

*Primary Examiner*—Mark L. Bell
*Assistant Examiner*—J. Pasterczyk
*Attorney, Agent, or Firm*—Sughrue, Mion, Zinn, Macpeak & Seas, PLLC

[57] ABSTRACT

The present invention provides a processing method which allows a silver halide color photographic material to be sufficiently desilvered and minimizes the rise in the formation of bleaching fog or stain even when it is processed in a short period of time. A novel process for the processing of a silver halide color photographic material comprising at least silver halide emulsion layer on a support which comprises subjecting the silver halide color photographic material to color development, and then processing the silver halide color photographic material with a processing solution having a bleaching capacity is provided, characterized in that said emulsion layer comprises tabular silver halide grains having [100] major faces and a silver chloride content of 50 to 100 mol % and said processing solution having a bleaching capacity contains at least one ferric complex salt of a compound represented by the following general formula (I):

(I)

wherein $R_1$, $R_2$, $R_3$, $R_4$, $R_5$ and $R_6$ each represent a hydrogen atom, aliphatic group, aromatic group or hydroxyl group; and W represents a divalent bridging group containing carbon atoms; and $M_1$, $M_2$, $M_3$ and $M_4$ each represent a hydrogen atom or cation. The total coated amount of silver in the silver halide color photographic material is in the range of 2.0 to 8.0 g/m$^2$ per m$^2$ of light-sensitive material. The compound represented by the general formula (I) comprises an [S,S] optical isomer as determined about the carbon atoms to which $R_1$ and $R_4$ are bonded in a proportion of not less than 70%.

14 Claims, No Drawings

METHOD FOR THE PROCESSING OF SILVER HALIDE COLOR PHOTOGRAPHIC MATERIAL

This is a Continuation of application Ser. No. 08/362,931 filed Dec. 23, 1994 now abandoned.

FIELD OF THE INVENTION

The present invention relates to a method for the processing of a silver halide color photographic material. More particularly, the present invention relates to a processing method which allows a silver halide color photographic material to be sufficiently desilvered and minimizes the rise in the formation of bleaching fog or stain even when it is processed in a short period of time.

BACKGROUND OF THE INVENTION

It is usual that when processed, silver halide color photographic materials, especially a film photographic material, which comprises a more coated amount of silver than printing material, drastically loads the development or desilvering step and takes much time.

On the other hand, with the recent spread of color laboratories (photofinishing laboratory), the photofinishing at shop called mini laboratories has been popular, possibly replacing the conventional photofinishing based on a collection-and-delivery system in the future. In the photofinishing at shop, one of important subjects is the shortening of the period of time required for photofinishing, especially of photographic films, which must be processed longer than other photographic materials.

When processed, photographic films which have been color-developed are bleached. As the bleaching agent there has been heretofore used ferric ethylenediaminetetraacetate. In order to reduce the processing time, ferric ethylenediaminetetraacetate has been replaced by ferric 1,3-propanediaminetetraacetate since a few years ago. Ferric 1,3-propanediaminetetraacetate allows photographic light-sensitive materials to be processed more rapidly than ferric ethylenediaminetetraacetate does.

On the other hand, JP-A-63-212932 (The term "JP-A" as used herein means an "unexamined published Japanese patent application") discloses high silver chloride content grains having {111} planes to be incorporated in a high silver chloride content photographic film. However, this technique leaves something to be desired in the capacity of desilvering emulsion and minimizing bleach fog.

Further, EP 053495A1 and U.S. Pat. No. 5,264,337 disclose a method for the formation of silver chloride content grains having {100} faces. However, this method is disadvantageous in that when a photographic light-sensitive material comprising such grains is processed with a bleaching solution containing the foregoing ferric ethylenediaminetetraacetate or ferric 1,3-propanediaminetetraacetate after color development, it suffers from yellow stain possibly caused by the production of silver sulfate or bleach fog of magenta, giving undesirable photographic properties.

SUMMARY OF THE INVENTION

It is therefore an object of the present invention to provide a method for the processing of a silver halide color photographic material. More particularly, the present invention relates to a processing method which allows a silver halide color photographic material to be sufficiently desilvered and minimizes the rise in the formation of bleaching fog or stain even when it is processed in a short period of time.

It is another object of the present invention to provide a processing method employing a bleaching agent which loads environment with little pollution.

These and other objects of the present invention will become more apparent from the following detailed description and examples.

The inventors made extensive studies to accomplish the foregoing objects of the present invention. As a result, it was found that the foregoing objects of the present invention are accomplished by a process for the processing of a silver halide color photographic material comprising at least silver halide emulsion layer on a support which comprises subjecting the silver halide color photographic material to color development, and then processing the silver halide color photographic material with a processing solution having a bleaching capacity, characterized in that said emulsion layer comprises tabular silver halide grains having {100} majors faces and a silver chloride content of 50 to 100 mol % and said processing solution having a bleaching capacity contains at least one ferric complex salt of a compound represented by the following general formula (I) or (II):

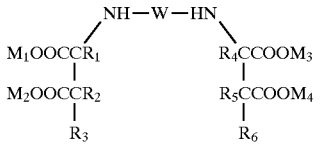

(I)

wherein $R_1$, $R_2$, $R_3$, $R_4$, $R_5$ and $R_6$ each represent a hydrogen atom, aliphatic group, aromatic group or hydroxyl group; and W represents a divalent bridging group containing carbon atoms; and $M_1$, $M_2$, $M_3$ and $M_4$ each represent a hydrogen atom or cation;

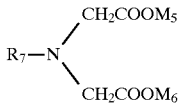

(II)

wherein $R_7$ represents an alkyl group; and $M_5$ and $M_6$ each represent a hydrogen atom or cation. The foregoing objects of the present invention are also accomplished by the processing method as defined above, wherein the total coated amount of silver in said silver halide color photographic material is in the range of 2.0 to 8.0 g per $m^2$ of light-sensitive material.

The ferric complex salt of a compound represented by the general formula (I) or (II) is disclosed in JP-A-5-019430 and JP-A-5-232655. However, it was quite unexpected that the processing of a specific photographic light-sensitive material as defined herein with such a ferric complex salt provides an enhanced capability of desilvering and minimizes the formation of bleaching fog as well as yellow stain caused by the production of silver sulfate.

DETAILED DESCRIPTION OF THE INVENTION

The general formula (I) will be further described hereinafter.

The aliphatic group represented by $R_1$, $R_2$, $R_3$, $R_4$, $R_5$ or $R_6$ is a straight-chain, branched or cyclic alkyl, alkenyl or alkinyl group, preferably having 1 to 10 carbon atoms. Preferred among these aliphatic groups is alkyl group, more preferably $C_{1-4}$ alkyl group, particularly methyl group or ethyl group.

The aromatic group represented by $R_1$, $R_2$, $R_3$, $R_4$, $R_5$ or $R_6$ is a monocyclic or bicyclic aryl group such as phenyl group and naphthyl group, preferably phenyl group.

The aliphatic or aromatic group represented by $R_1$, $R_2$, $R_3$, $R_4$, $R_5$ or $R_6$ may contain substituents. Examples of the substituents include alkyl group (e.g., methyl, ethyl), aralkyl group (e.g., phenylmethyl), alkenyl group (e.g., allyl), alkinyl group, alkoxy group (e.g., methoxy, ethoxy), aryl group (e.g., phenyl, p-methylphenyl), amino group (e.g., dimethylamino), acylamino group (e.g., acetylamino), sulfonylamino group (e.g., methanesulfonylamino), ureide group, urethane group, aryloxy group (e.g., phenyloxy), sulfamoyl group (e.g., methylsulfamoyl), carbamoyl group (e.g., carbamoyl, methylcarbamoyl), alkylthio group (e.g., methylthio), arylthio group (e.g., phenylthio), sulfonyl group (e.g., methanesulfonyl), sulfinyl group (e.g., methanesulfinyl), hydroxyl group, halogen atom (e.g., chlorine, bromine, fluorine), cyano group, sulfo group, carboxyl group, phosphono group, aryloxycarbonyl group (e.g., phenyloxycarbonyl), acyl group (e.g., acetyl, benzoyl), alkoxycarbonyl group (e.g., methoxycarbonyl), acyloxy group (e.g., acetoxy), carbonamide group, sulfonamide group, nitro group, and hydroxamic group. These substituents may be optionally in dissociated or salt form.

Such a substituent preferably contains 1 to 4 carbon atoms, if any.

The group represented by $R_1$, $R_2$, $R_3$, $R_4$, $R_5$ or $R_6$ is preferably a hydrogen atom or hydroxyl group, more preferably hydrogen atom.

The divalent bridging group represented by W is preferably represented by the following general formula (W)

$$—(W^1—D)_m—(W^2)_n— \quad (W)$$

wherein $W^1$ and $W^2$ may be the same or different and each represents a $C_{1-8}$ straight-chain or branched alkylene group (e.g., ethylene, propylene), $C_{5-10}$ cycloalkylene group (e.g., 1,2-cyclohexyl), $C_{6-10}$ arylene group (e.g., o-phenylene), $C_{7-10}$ aralkylene group (e.g., o-xylenyl) or divalent nitrogen-containing heterocyclic or carbonyl group; and D represents —O—, —S—, —N($R_w$)— or divalent nitrogen-containing heterocyclic group in which $R_w$ represents a hydrogen atom or $C_{1-18}$ alkyl group (e.g., methyl) or $C_{6-10}$ aryl group (e.g., phenyl) which is optionally substituted by —$COOM_a$, —$PO_3M_bM_c$, —OH or —$SO_3M_d$ (in which $M_a$, $M_b$, $M_c$ and $M_d$ each represent a hydrogen atom or cation). Examples of such a cation include alkaline metal ions (e.g., lithium, sodium and potassium ions), ammonium ions (e.g., ammonium ion, tetraethyl ammonium ion), and pyridinium ions. The bridging group represented by W is substituted by substituents. As these substituents there may be used those listed with reference to $R_1$ to $R_6$.

The divalent nitrogen-containing heterocyclic group represented by D is preferably a 5- or 6-membered nitrogen-containing heterocyclic group having nitrogen atom as hetero atom, more preferably one which is connected to $W^1$ and $W^2$ via adjacent carbon atom, such as imidazolyl group.

Preferred among the groups represented by $W^1$ or $W^2$ is $C_{2-4}$ alkylene group.

The suffix m represents an integer 0 to 3. When m is 2 or 3, the plurality of ($W^1$—D) may be the same or different. The suffix m is preferably 0, 1 or 2, more preferably 0 or 1, particularly 0. The suffix n represents an integer 1 to 3. When n is 2 or 3, the plurality of $W^2$ may be the same or different. The suffix n is preferably 1 or 2.

Specific examples of the group represented by W will be listed below:

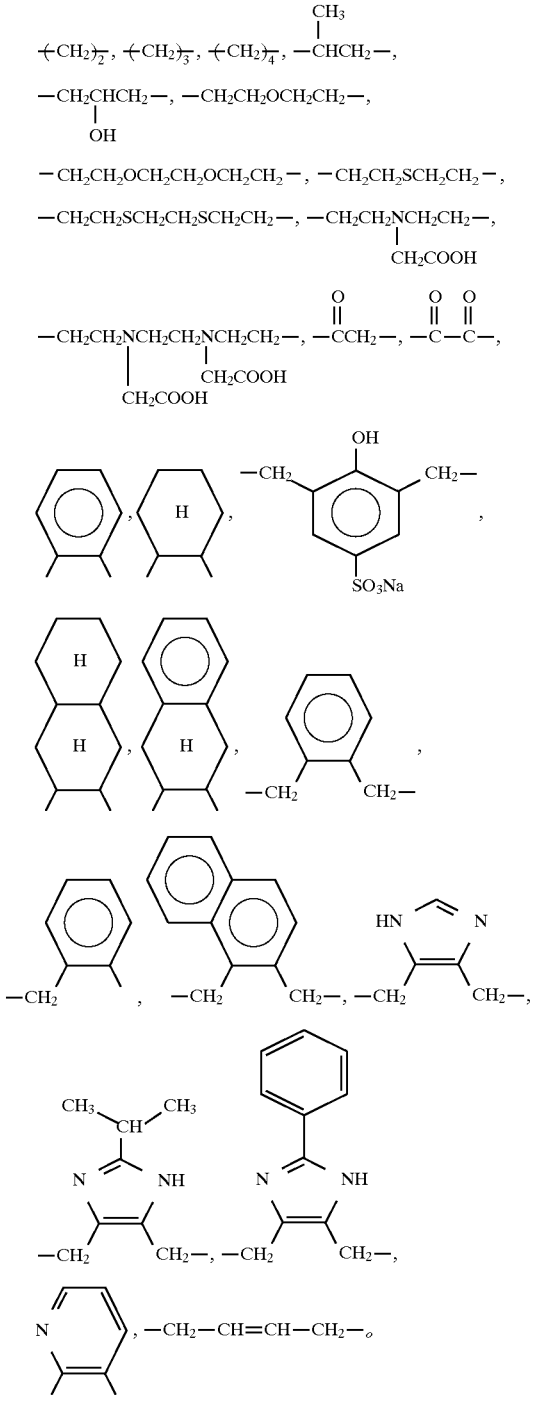

Examples of the cation represented by $M_1$, $M_2$, $M_3$ or $M_4$ include alkaline metal ions (e.g., lithium, sodium and potassium ions), ammonium ions (e.g., ammonium ion, tetraethyl ammonium ion), and pyridinium ions.

Specific examples of the compound of the present invention represented by the general formula (I) will be listed below, but the present invention should not be construed as being limited thereto.

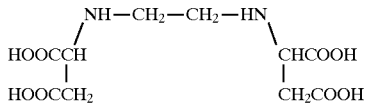
I-1.
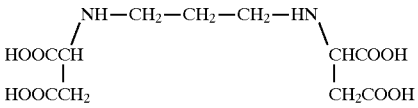
I-2.
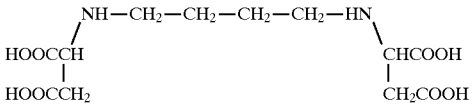
I-3.
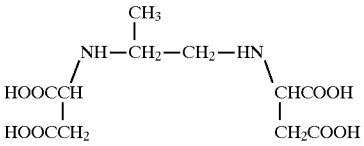
I-4.
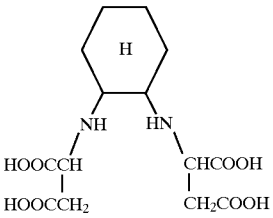
I-5.
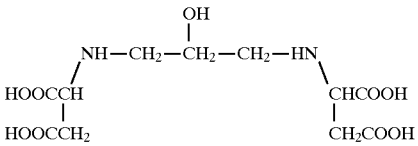
I-6.
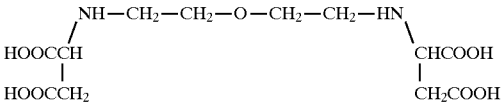
I-7.
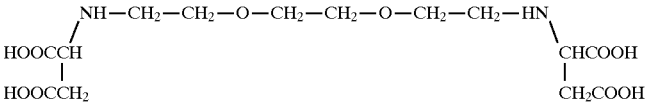
I-8.
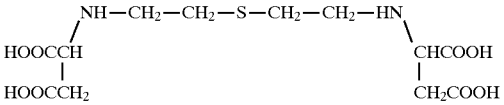
I-9.
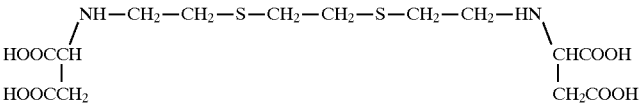
I-10.
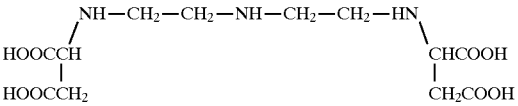
I-11.
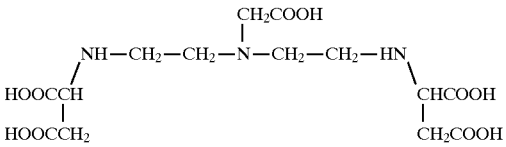
I-12.
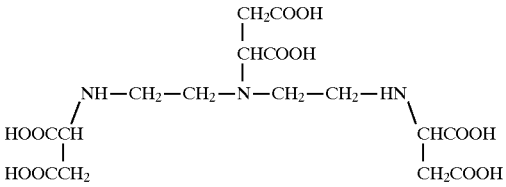
I-13.
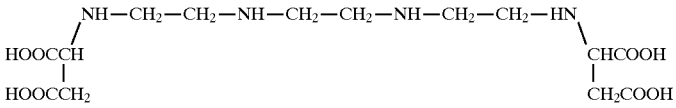
I-14.
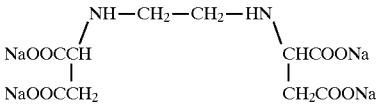
I-15.
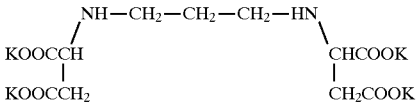
I-16.

-continued

I-17.

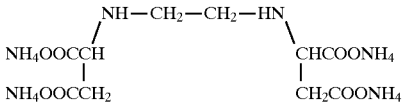

I-18.

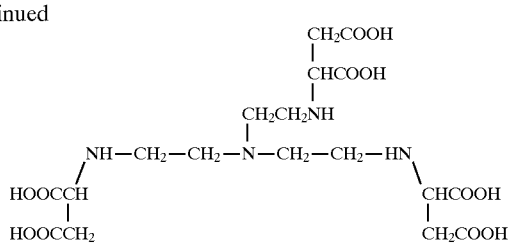

I-19.

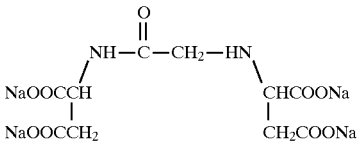

I-20.

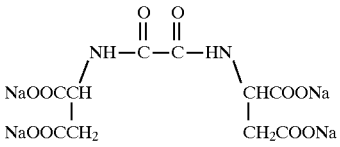

I-21.

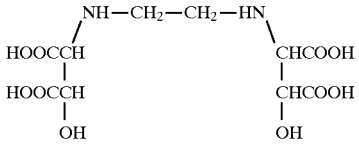

I-22.

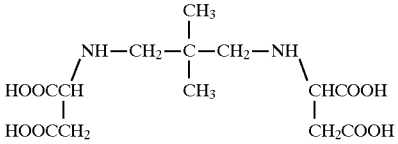

I-23.

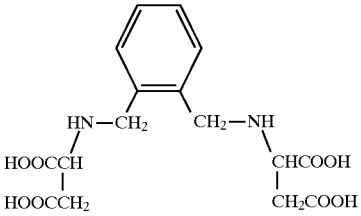

I-24.

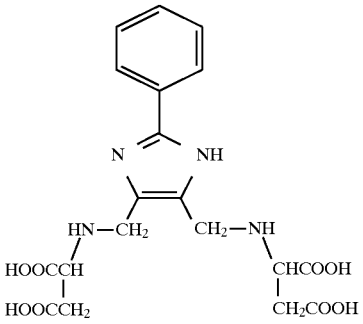

I-25.

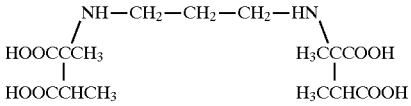

I-26.

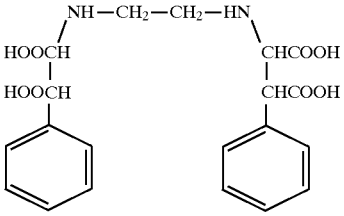

I-27.

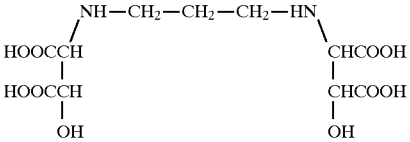

The compound represented by the general formula (I) may be in the form of any optical isomer, i.e., [S,S] form, [S,R] form, [R,S] form, [R,R] form, mixture thereof. For example, Exemplary Compound (I-1) may be in [S,S] form, [S,R] form, [R,R] form or mixture thereof.

In order to provide an improved desilvering efficiency and minimize the formation of yellow stain, it is preferred that [S,S] form be selectively used among optical isomers. A compound synthesized from an amino acid in L form as a starting material such as Exemplary Compound (I-1) is preferably used. Further, [S,S] form is advantageously biodegradable.

The term "selectively" as used herein is meant to indicate that the mixture of optical isomers comprises [S,S] form in a proportion of not less than 70%, preferably not less than 90%.

The synthesis of the compound of the present invention represented by the general formula (I) can be accomplished by the method described in JP-A-63-199295 and JP-A-3-173857. These patents concern a detergent composition prepared with a compound of the general formula (I) as a chelating agent. However, these patents have no reference to the fact that ferric complex salts of the compound (I) are useful as bleaching agents for silver halide color photographic materials.

The selective synthesis of [S,S] form can be accomplished by the method described in Umezawa et al., "The Journal of Antibiotics", vol. XXXVII, No. 4, pp. 426 (April 1984).

Specific examples of the ferric complex salt employable in the present invention will be listed below, but the present invention should not be construed as being limited thereto.

K-1.

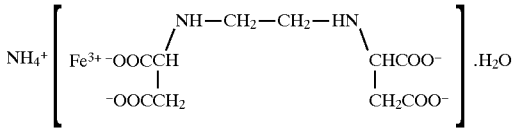

K-2.

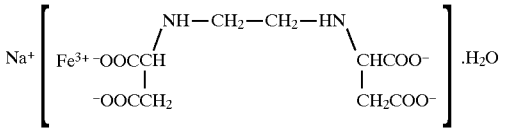

K-3.

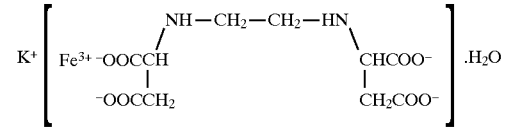

K-4.

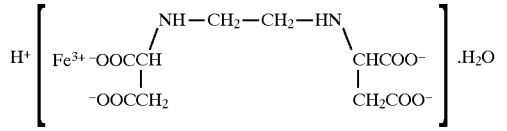

K-5.

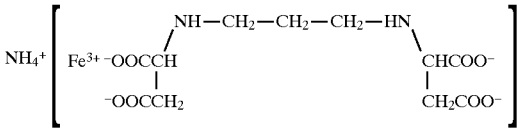

K-6.

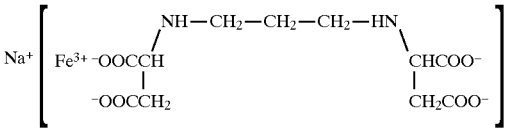

K-7.

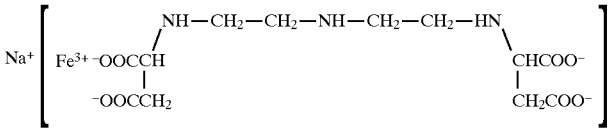

K-8.

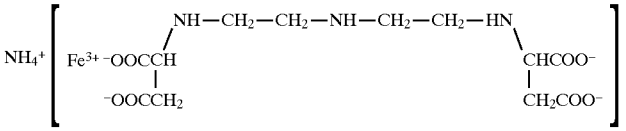

K-9.

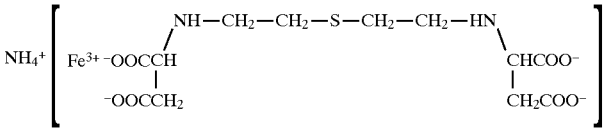

K-10.

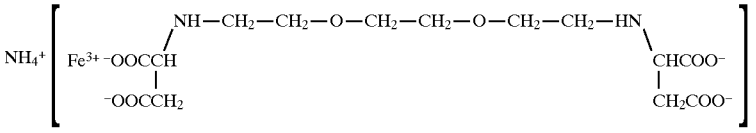

The compound represented by the general formula (II) will be further described hereinafter.

In the general formula (II), $R_7$ represents an alkyl group, preferably $C_{1-4}$ alkyl group in particular. The alkyl group is optionally substituted by substituents. Preferred examples of substituents include carboxyl group, hydroxyl group, halogen atom, sulfonic group, nitro group, and amino group. If necessary, the alkyl group may contain two or more of these substituents. Particularly preferred among these substituents are carboxyl group and hydroxyl group.

$M_5$ and $M_6$ each represent a hydrogen atom or cation. Examples of the cation include alkaline metal ions (e.g., lithium, sodium and potassium ions), ammonium ions (e.g., ammonium ion, tetraethyl ammonium ion), and pyridinium ions.

Specific examples of the compound represented by the general formula (II) will be listed below, but the present invention should not be construed as being limited thereto.

II-1

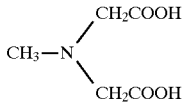

II-2

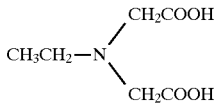

II-3

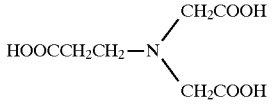

II-4

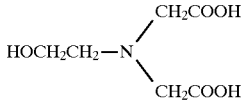

-continued

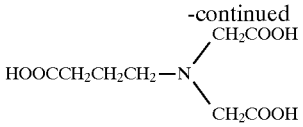
II-5

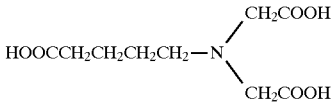
II-6

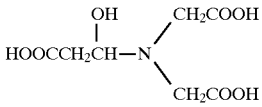
II-7

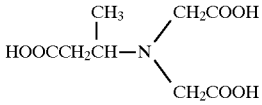
II-8

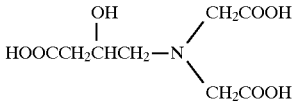
II-9

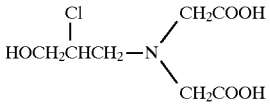
II-10

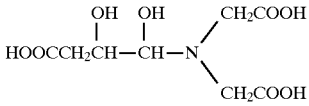
II-11

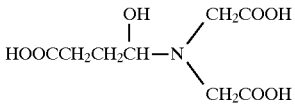
II-12

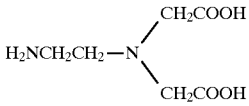
II-13

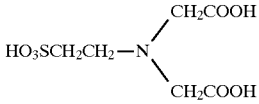
II-14

The compound represented by the general formula (II) is commercially available.

The processing solution of the present invention having a bleaching capacity is used as one processing solution in the desilvering step.

The desilvering step will be further described hereinafter.

In the desilvering step, bleach and fixing may be effected at separate steps or may be simultaneously effected as a bleach step. Alternatively, these steps may be combined. Specific examples of these steps will be listed below, but the present invention should not be construed as being limited thereto.

(Step 1) Bleach—fixing (Step 2) Blix (Step 3) Bleach—blix (Step 4) Bleach—blix—fixing (Step 5) Fixing—blix These bleach, blix and fixing steps may be each partitioned by a plurality of baths to form a cascade process.

In a preferred embodiment of the present invention, the processing solution having a bleaching capacity is a blix solution and the desilvering step is Step 2 disclosed above to exert remarkable effects and accomplish the simplification of the desilvering procedures.

As the bleaching agent to be contained in the processing solution having a bleaching capacity there may be used a ferric complex salt of a compound represented by the foregoing general formula (I) or (II).

The ferric complex salt to be used in the present invention may be dissolved in the form of ferric salt which has been previously complexed. Alternatively, a complexing compound and a ferric salt (e.g., ferric sulfate, ferric chloride, ferric bromide, ferric nitrate, ferric ammonium sulfate) may be allowed to be present together in the processing solution having a bleaching capacity to form a complex salt.

The complexing compound may be used slightly in excess of the amount required to complexing with ferric ions. In this case, the excess is preferably in the range of 0.01 to 10%.

The ferric complex salt-forming compound to be contained in the processing solution having a bleaching capacity (e.g., bleaching solution, blix solution) preferably comprises a compound represented by the foregoing general formula (I) or (II) in a proportion of not less than 50 mol %, more preferably not less than 80 mol %.

In the present invention, as the ferric complex salt-forming compound to be contained in the processing solution having a bleaching capacity there may be used a compound represented by the foregoing general formula (I) or (II), singly or in combination.

As the ferric complex salt-forming compound to be contained in the processing solution having a bleaching capacity there may be used a compound other than represented by the foregoing general formula (I) or (II) so far as the effects of the present invention can be exerted. Examples of such a compound include EDTA, 1,3-PDTA, diethylenetriaminepentaacetic acid, 1,2-cyclohexanediaminetetraacetic acid, iminodiacetic acid, methyliminodiacetic acid, N-(2-acetamide)iminodiacetic acid, nitrilotriacetic acid, N-(2-carboxyethyl)iminodiacetic acid, and N-(2-carboxymethyl)iminodipropionic acid, but the present invention should not be construed as being limited thereto.

In the present invention, as the bleaching agent to be contained in the processing solution having a bleaching capacity there may be an inorganic oxidizer in addition to the foregoing ferric complex salt so far as the effects of the present invention are not impaired. Examples of such an inorganic oxidizer include hydrogen peroxide, persulfates, and bromates, but the present invention should not be construed as being limited thereto.

The optimum concentration of ferric complex in the processing solution having a bleaching capacity is in the range of 0.005 to 1.0 mol/l, preferably 0.01 to 0.50 mol/l, more preferably 0.02 to 0.30 mol/l.

The concentration of ferric complex in the replenisher of the processing solution having a bleaching capacity is preferably in the range of 0.005 to 2 mol/l, more preferably 0.01 to 1.0 mol/l.

The bleaching bath, blix bath and/or prebath thereof may comprise various compounds as bleach accelerators. For example, compounds having mercapto group or disulfide bond as disclosed in U.S. Pat. No. 3,893,858, German Patent 1,290,812, JP-A-53-95630, and Research Disclosure No. 17129 (July 1978), thiourea compounds as disclosed in JP-B-45-8506 (The term "JP-B" as used herein means an "examined Japanese patent publication"), JP-A-52-20832, JP-A-53-32735, and U.S. Pat. No. 3,706,561, and halides such as iodide and bromide are advantageous in that they have an excellent bleaching capacity.

The bleaching solution or blix solution employable in the present invention may contain a rehalogenating agent such as bromide (e.g., potassium bromide, sodium bromide, ammonium bromide), chloride (e.g., potassium chloride, sodium chloride, ammonium chloride) and iodide (e.g., ammonium iodide). If necessary, the bleaching solution or blix solution may comprise one or more inorganic acids, organic acids and alkaline metal or ammonium salts thereof having a pH buffering capacity such as borax, sodium metaborate, acetic acid, sodium acetate, sodium carbonate, potassium carbonate, phosphorous acid, phosphoric acid, sodium phosphate, citric acid, sodium citrate and tartaric acid, or corrosion inhibitors such as ammonium nitrate and guanidine.

The bleaching solution or blix solution may further comprise various fluorescent brightening agents, antifoaming agents, surface active agents, and organic solvents such as polyvinyl pyrrolidone and methanol incorporated therein.

As the fixing agent to be contained in the blix solution or fixing solution there may be used a known fixing agent. Examples of such a known fixing agent include thiosulfates such as sodium thiosulfate and ammonium thiosulfate, thiocyanates such as sodium thiocyanate and ammonium thiocyanate, thioether compounds such as ethylenebisthioglycolic acid and 3,6-dithia-1,8-octanediol, and water-soluble silver halide solvents such as thiourea. These fixing agents may be used singly or in admixture. Further, a specific blix solution comprising a fixing agent and a large amount of a halide such as potassium iodide in combination as described in JP-A-55-155354 can be used. In the present invention, a thiosulfate, particularly ammonium thiosulfate, may be preferably used. The amount of the fixing agent is preferably in the range of 0.3 to 2 mol, more preferably 0.5 to 1.0 mol per l.

The blix solution or fixing solution may preferably comprise as a preservative a sulfurous ion-releasing compound such as sulfite (e.g., sodium sulfite, potassium sulfite, ammonium sulfite), bisulfite (e.g., ammonium bisulfite, sodium bisulfite, potassium bisulfite), metabisulfite (e.g., potassium metabisulfite, sodium metabisulfite, ammonium metabisulfite) incorporated therein. Such a sulfurous ion-releasing compound is preferably contained in an amount of about 0.02 to 0.05 mol/l, more preferably 0.04 to 0.40 mol/l as calculated in terms of sulfurous ion.

The blix solution or fixing solution normally comprises a sulfite incorporated therein as a preservative. Alternatively, ascorbic acid, carbonyl-bisulfite adduct, or carbonyl compound may be contained in the blix solution or fixing solution. Further, benzenesulfinic acids are useful. The blix solution or fixing solution may optionally comprise a buffer, fluorescent brightening agent, chelating agent, antifoaming agent, antifungal agent or the like incorporated therein.

The optimum pH value of the bleaching solution, blix solution or fixing solution to be used in the present invention is in the range of 3 to 10, preferably 4 to 9. In particular, the bleaching solution or blix solution preferably exhibits a pH value of 4 to 5.8.

The rate of replenishment of bleaching bath, blix bath or fixing bath is preferably in the range of 20 to 300 ml, particularly 25 to 200 ml, more preferably 30 to 150 ml per $m^2$ of light-sensitive material.

The temperature at which the processing is effected with the bleaching solution, blix solution or fixing solution employable in the present invention is in the range of 20° to 50° C., preferably 30° to 40° C. The processing time is in the range of 10 seconds to 3 minutes, preferably 10 seconds to 2 minutes.

The processing solution having bleaching capacity of the present invention is preferably aerated upon processing to provide extreme stabilization of photographic properties. Aeration can be effected by a means known in the art. For example, air may be blown through the processing solution having bleaching capacity. Alternatively, an ejector may be utilized to absorb air.

In the case where air is blown through the processing solution, air is preferably released into the processing solution through an air diffuser pipe having fine pores. Such an air diffuser pipe is widely used in an aeration tank for the treatment of activated sludge. For the details of aeration, reference can be made to Eastman Kodak's technical bulletin Z-121, Using Process C-41, 3rd edition, 1982, pp. BL-1 to BL-2. In the processing with the processing solution having bleaching capacity of the present invention, agitation is preferably intensified. For the implementation of this process, reference can be made to JP-A-3-33847, line 6, upper right column to line 2, lower left column, page 8.

In the desilvering step, the agitation is preferably intensified as much as possible. Specific examples of such an agitation intensifying method include a method as described in JP-A-183460 which comprises jetting the processing solution to the surface of the emulsion layer in the light-sensitive material, a method as described in JP-A-62-183461 which comprises improving the agitating effect by a rotary means, a method which comprises improving the agitating effect by moving the light-sensitive material with the emulsion surface in contact with a wiper blade provided in the bath so that turbulence occurs on the emulsion surface, and a method which comprises increasing the total circulated amount of processing solution. Such an agitation improving method can be effectively applied to the bleaching bath, blix bath or fixing bath. The improvement in agitation effect can be considered to expedite the supply of a bleaching agent, fixing agent or the like into emulsion film, resulting in an improvement in desilvering rate. The above mentioned agitation improving means can work more effectively when a bleach accelerator is used, remarkably increasing the bleach acceleration effect and eliminating the inhibition of fixing by the bleach accelerator.

The automatic developing machine to be used in the processing of the light-sensitive material of the present invention is preferably equipped with a light-sensitive material conveying means as disclosed in JP-A-60-191257, 60-191258, and 60-191259. Such a conveying means can remarkably reduce the amount of the processing solution carried from a bath to its subsequent bath, providing a high effect of inhibiting deterioration of the properties of the processing solution. This effect is remarkably effective for the reduction of the processing time or the amount of replenisher required at each step.

The overflow solution produced from the processing with the processing solution having bleaching capacity of the present invention may be recovered, modified with necessary components for correct composition, and then re-used. This process is normally called regeneration. In the present invention, such regeneration is preferably effected. For the details of regeneration, reference can be made to "Fuji Film Processing manual-Fuji Color Negative Film; CN-16 Processing", Fuji Film Co., Ltd., August 1990, pp. 39–40.

The kit for adjusting the processing solution having bleaching capacity of the present invention may be used in the form of liquid or powder. Since the most materials except ammonium salts are supplied in the form of powder which absorbs less moisture, the kit can be easily prepared in the form of powder.

The foregoing kit for regeneration is preferably supplied in the form of powder which can be added as it is without any extra water in the light of reduction of the amount of waste liquid.

The regeneration of the processing solution having bleaching capacity can be accomplished by the foregoing aeration as well as method described in "Shashin Kogaku no Kiso-Ginenshashinhen (Fundamentals of Photographic Engineering—Silver Salt Photograph)", Society of Photographic Science and Technology of Japan, Corona, 1979. In some detail, the bleaching solution can be electrolytically regenerated. Alternatively, the bleaching solution can be regenerated with bromic acid, chlorous acid, bromine, bromine precursor, persulfate, hydrogen peroxide, hydrogen peroxide utilizing a catalyst, bromous acid, ozone, etc.

In the electrolytic regeneration, a cathode and an anode may be dipped in the same bleaching bath. Alternatively, the regeneration may be effected with the anode bath and cathode bath being partitioned by a membrane. Further, the bleaching solution and developer and/or fixing solution may be simultaneously regenerated in a system using a membrane.

The regeneration of the fixing solution or blix solution can be accomplished by the electrolytic reduction of silver ions accumulated. Further, halogen ions accumulated are preferably removed by an anion exchange resin to maintain the desired fixing capacity.

The photographic light-sensitive material according to the present invention can be developed in accordance with an ordinary method as described in RD Nos. 17643 (pp. 28–29), 18716 (left column—right column on page 651) and 30710 (pp. 880–881).

The color developer to be used in the development of the present light-sensitive material is preferably an alkaline aqueous containing as a main component an aromatic primary amine color developing agent. As such a color developing agent there can be effectively used an aminophenolic compound. In particular, p-phenylenediamine compounds are preferably used. Typical examples of such p-phenylenediamine compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamideethylaniline, 3-methyl-4-amino-N-ethyl-N-β-methoxyethylaniline, 4-amino-3-methyl-N-methyl-N-(3-hydroxypropyl)aniline, 4-amino-3-methyl-N-ethyl-N-(3-hydroxypropyl)aniline, 4-amino-3-methyl-N-ethyl-N-(2-hydroxypropyl)aniline, 4-amino-3-ethyl-N-ethyl-N-(3-hydroxypropyl)aniline, 4-amino-3-methyl-N-propyl-N-(3-hydroxypropyl)aniline, 4-amino-3-propyl-N-methyl-N-3-hydroxypropyl)aniline, 4-amino-3-methyl-N-methyl-N-(4-hydroxybutyl)aniline, 4-amino-3-methyl-N-ethyl-N-(4-hydroxybutyl)aniline, 4-amino-3-methyl-N-propyl-N-(4-hydroxybutyl)aniline, 4-amino-3-ethyl-N-ethyl-N-(3-hydroxy-2-methylpropyl)aniline, 4-amino-3-methyl-N,N-bis(4-hydroxybutyl)aniline, 4-amino-3-methyl-N,N-bis(5-hydroxypentyl)aniline, 4-amino-3-methyl-N-(5-hydroxypentyl)-N-(4-hydroxybutyl)aniline, 4-amino-3-methoxy-N-ethyl-N-(4-hydroxybutyl)aniline, 4-amino-3-ethoxy-N,N-bis(5-hydroxypentyl)aniline, 4-amino-3-propyl-N-(4-hydroxybutyl)aniline, and sulfates, hydrochlorides and p-toluenesulfonates thereof. Particularly preferred among these compounds are 3-methyl-4-amino-N-ethyl-N-β-hydroxyethylaniline, 4-amino-3-methyl-N-ethyl-N-(3-hydroxypropyl)aniline, 4-amino-3-methyl-N-ethyl-N-(4-hydroxybutyl)aniline, and hydrochlorides, p-toluenesulfonates and sulfates thereof. These compounds can be used in combination of two or more thereof depending on the purpose of application.

The amount of the aromatic primary amine developing agent to be used is preferably in the range of 0.0002 to 0.2 mol, more preferably 0.001 to 0.1 mol per 1 of color developer.

The color developer normally contains a pH buffer such as carbonate, borate, phosphate and 5-sulfosalicylate of alkaline metal or a development inhibitor or fog inhibitor such as chlorides, bromides, iodides, benzimidazoles, benzothiazoles and mercapto compounds. If desired, the color developer may further contain various preservatives such as hydroxylamine, diethylhydroxylamine, hydroxylamines represented by the general formula (I) in JP-A-3-144446, sulfites, hydrazines (e.g., N,N-biscarboxymethylhydrazine), phenylsemicarbazides, triethanolamine and catecholsulfonic acids; organic solvents such as ethylene glycol and diethylene glycol; development accelerators such as benzyl alcohol, polyethylene glycol, quaternary ammonium salts, and amines; color-forming couplers; competing couplers; auxiliary developing agents such as 1-phenyl-3-pyrazolidone; viscosity-imparting agents; and various chelating agents exemplified by aminopolycarboxylic acids, aminopolyphosphoric acids, alkylphosphonic acids, and phosphonocarboxylic acids (e.g., ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, and ethylenediamine-di(o-hydroxyphenylacetic acid), and salts thereof).

Most preferred among these preservatives are substituted hydroxylamines. Particularly preferred among these substituted hydroxylamines are diethylhydroxylamine, monomethylhydroxylamine, and those having as a substituent an alkyl group substituted by sulfo group, carboxyl group or water-soluble group such as hydroxyl group. The most preferred examples of the substituted hydroxylamine include N,N-bis(2-sulfoethyl)hydroxylamine and alkaline metal salts thereof.

As the chelating agent there may be preferably used a biodegradable compound. Examples of the chelating agent compound include those described in JP-A-63-146998, JP-A-63-199295, JP-A-63-267750, JP-A-63-267751, JP-A-2-229146, JP-A-3-186841, German Patent 3,739,610, and EP 468325.

The color developer replenisher tank and the processing solution tank are preferably shielded by a liquid agent such as high boiling organic solvent to reduce the area in contact with air. The most preferred liquid shielding agent is liquid paraffin. In particular, the shielding agent is preferably used for replenisher tanks.

The temperature at which the processing is effected with the color developer of the present invention is in the range of 20° to 55° C., preferably 30° to 55° C. The processing time with photographic light-sensitive material for picture taking is in the range of 20 seconds to 5 minutes, preferably 30 seconds to 3 minutes and 20 seconds, more preferably 40 seconds to 2 minutes and 30 seconds. The processing time with printing photographic light-sensitive material is in the range of 10 seconds to 1 minute and 20 seconds, preferably 10 seconds to 60 seconds, more preferably 10 seconds to 40 seconds.

Reversal processing is usually carried out by black-and-white development followed by color development. Black-and-white developers to be used can contain one or more of known black-and-white developing agents, such as dihydroxybenzenes, e.g., hydroquinone, 3-pyrazolidones, e.g., 1-phenyl-3-pyrazolidone, and aminophenols, e.g., N-methyl-p-aminophenol.

The color developer or black-and-white developer usually has a pH of from 9 to 12. The replenishment rate of the developer is usually 3 l or less per $m^2$ of the light-sensitive material, though depending on the type of the color photographic material to be processed. The replenishment rate may be reduced to 500 $ml/m^2$ or less by decreasing the bromide ion concentration or the chloride ion concentration in the replenisher. If the replenishment rate is reduced, the area of the processing tank in contact with air is preferably reduced to inhibit the evaporation and air oxidation of the processing solution.

The area of the photographic processing solution in contact with air in the processing tank can be represented by an opening value as defined by the following equation:

$$\text{Opening value} = [\text{area of processing solution in contact with air } (cm^2)/[\text{volume of processing solution } (cm^3)]$$

The opening value as defined above is preferably in the range of 0.1 or less, more preferably 0.001 to 0.05. Examples of methods for reducing the opening value include a method which comprises putting a cover such as floating lid on the surface of the processing solution in the processing tank, a method as disclosed in JP-A-1-82033 utilizing a mobile lid, and a slit development method as disclosed in JP-A-63-216050. The reduction of the opening value is preferably effected in both color development and black-and-white development steps as well as all the subsequent steps such as bleach, blix, fixing, rinse and stabilization. The replenishment rate can also be reduced by a means for suppressing accumulation of the bromide ion or the chloride ion in the developing solution.

It is usual that the thus desilvered photographic light-sensitive material of the invention are subjected to washing and/or stabilization. The quantity of water to be used in the washing can be selected from a broad range depending on the characteristics of the light-sensitive material (for example, the kind of couplers, etc.), the end use of the light-sensitive material, the temperature of washing water, the number of washing tanks (number of stages), the replenishment system (e.g., counter-flow system or forward-flow system), and other various factors. Of these factors, the relationship between the number of washing tanks and the quantity of water in a multistage counter-flow system can be obtained according to the method described in "Journal of the Society of Motion Picture and Television Engineers", vol. 64, pp. 248–253 (May 1955). According to the multi-stage counter-flow system described in the above reference, although the requisite amount of water can be greatly reduced, bacteria would grow due to an increase of the retention time of water in the tank, and floating masses of bacteria stick to the light-sensitive material. In the present invention, in order to cope with this problem, the method of reducing calcium and magnesium ion concentrations described in JP-A-62-288838 can be used very effectively. Further, it is also effective to use isothiazolone compounds or thiabenzazoles as described in JP-A-57-8542, chlorine type bactericides, e.g., chlorinated sodium isocyanurate, benzotriazole, and bactericides described in Hiroshi Horiguchi, "Bokinbobaizai no kagaku" (1986), Eisei Gijutsu Gakkai (ed.), "Biseibutsu no mekkin, sakkin, bobigijutsu" (1982), and Nippon Bokin Bobi Gakkai (ed.), "Bokin bobizai jiten" (1986).

The washing water has a pH value of from 4 to 9, preferably from 5 to 8. The temperature of the water and the washing time can be selected from broad ranges depending on the characteristics and end use of the light-sensitive material, but usually ranges from 15° to 45° C. in temperature and from 20 seconds to 10 minutes in time, preferably from 25° to 45° C. in temperature and from 30 seconds to 5 minutes in time. The light-sensitive material of the invention may be directly processed with a stabilizer in place of the washing step. For the stabilization, any of the known techniques as described in JP-A-57-8543, 58-14834, and 60-220345 can be used.

The stabilizing solution may contain a compound for stabilizing dye image, such as formalin, benzaldehydes such as m-hydroxybenzaldehyde, formaldehyde-bisulfurous acid adduct, hexamethylenetetramine and derivatives thereof, hexahydrotriazine and derivatives thereof, dimethylolurea, N-methylol compound such as N-methylolpyrazole, organic acid, and pH buffer. The added amount of such a compound is preferably in the range of 0.001 to 0.02 mol per l of stabilizer. The concentration of free formaldehyde in the stabilizer is preferably kept low to minimize the scattering of formaldehyde. In this respect, as the dye image stabilizer there may be preferably used m-hydroxybenzaldehyde, hexamethylene-tetramine, m-methylolazoles such as N-methylolpyrazole as described in JP-A-4-270344, azolylmethylamines such as N,N'-bis(1,2,4-triazole-1-ylmethyl) piperazine as described in JP-A-4-313753, etc. In particular, the combined use of azoles such as 1,2,4-triazole as described in JP-A-4-359249 (corresponding to EP-A-519190 A2) and azolylmethylamine such as 1,4-bis(1,2,4-triazole-1-ylmethyl) and its derivatives advantageously provides a high image stability and a low formaldehyde vapor pressure. The stabilizer may further contain an ammonium compound such as ammonium chloride and ammonium sulfite, compound of metal such as Bi and Al, fluorescent brightening agent, hardener, alkanolamine described in U.S. Pat. No. 4,786,583, preservative which can be incorporated in the foregoing fixing solution or blix solution, such as sulfinic acid as described in JP-A-1-231051, etc.

The rinsing water and/or stabilizer may contain various surface active agents to inhibit uneven distribution of water droplets during the drying of the photographic light-sensitive material which has been processed. In particular, nonionic surface active agents are preferred. Particularly preferred among these nonionic surface active agents is alkylphenolethylene oxide adduct. As the alkylphenol there is preferably used octyl, nonyl, dodecyl, dinonylphenol or the like. The number of mol of ethylene oxide to be added is preferably in the range of 8 to 14. Further, a silicone surface active agent having a high antifoaming effect can be preferably used.

The rinsing water and/or stabilizer preferably contains various chelating agents. Preferred examples of these chelating agents include aminopolycarboxylic acids such as ethylenediaminetetraacetic acid and diethylenetriaminepentaacetic acid, organic phosphonic acids such as 1-hydroxyethylidene-1,1-diphosphonic acid, N,N,N'-trimethylenephosphonic acid and diethylenetriamine-N,N,N',N'-tetramethylenephosphonic acid, and hydrolyzate of anhydrous maleic polymers as described in EP 345,172A1.

The overflow accompanying replenishment of the washing bath and/or stabilizing bath can be reused in other steps such as desilvering.

In a processing using an automatic developing machine, if the above mentioned various processing solutions are subject to concentration due to evaporation, the concentration due to evaporation is preferably corrected for by the addition of a proper amount of water, correcting liquid or processing replenisher. The method for the replenishment with water is not specifically limited. In particular, a method described in JP-A-1-254959 and JP-A-1-254960 which comprises replenishing the bleaching bath with water in proportion to the evaporation loss of water in the bleaching bath calculated from the evaporation loss of water determined in a monitor water bath provided separately of the bleaching bath is preferred. Further, an evaporation correction method using a liquid level sensor or overflow sensor as described in JP-A-3-248155, JP-A-3-249644, JP-A-3-249645, and JP-A-3-249646 is preferred. As the water for correcting for the evaporation loss of the various processing solutions there may be used tap water. Deionized water or sterilized water which can be preferably used in the foregoing rinsing step is preferred.

The photographic light-sensitive material of the present invention will be further described hereinafter.

The tabular silver halide grains (hereinafter optionally referred to as "tabular grains") having {100} planes major faces and a silver chloride content of not less than 50 mol % to be used in the present invention preferably has a silver chloride content of not less than 75 mol %, more preferably not less than 90 mol %, most preferably not less than 95 mol %. The upper limit of the silver chloride content is 100 mol %.

The silver halide emulsion to be used in the present invention comprises at least a dispersant and the foregoing silver halide grains. Tabular silver halide grains having {100} majors faces account for not less than 10%, preferably from 35% to 100%, more preferably from 60% to 100 %, of all silver halide grains in the emulsion as calculated in terms of projected area. The term "projected area" as used herein is meant to indicate the projected area determined under the conditions that silver halide grains are not superimposed on each other and tabular grains are placed on a substrate with its main planes being parallel thereto. The term "main planes" as used herein is meant to indicate two parallel largest external surfaces of a tabular grain. The aspect ratio (diameter/thickness) of the tabular grain is not less than 1.5, preferably not less than 2, more preferably from 3 to 25, particularly from 3 to 15. The term "grain diameter" as used herein is meant to indicate the diameter of the circle having the same area as the projected area of the grain determined under electron microscope. The term "grain thickness" as used herein is meant to indicate the distance between the main planes of the tabular grain. The diameter of the tabular silver halide grain is preferably not more than 10 $\mu$m, more preferably from 0.2 to 5 $\mu$m, particularly from 0.2 to 3 $\mu$m. The thickness of the tabular silver halide grain is preferably not more than 0.7 $\mu$m, more preferably from 0.03 to 0.3 $\mu$m, particularly from 0.05 to 0.2 $\mu$m. The grain size distribution of the tabular grains is preferably monodisperse. The coefficient of variation of the grain size distribution of the tabular grains is preferably not more than 40%, more preferably not more than 20%

The "main faces" are defined as a pair of parallel faces having the greatest area among the surfaces forming a substantially rectangular parallelopiped emulsion grain. The majors faces can be confirmed to be {100} faces by electron diffractometry or X-ray diffractometry. The term "substantially rectangular parallelepiped emulsion grain" as used herein means an emulsion grain having majors planes formed by {100} planes but possibly having 1 to 8 of {111} crystal faces. In other words, 1 to 8 among the eight corners of the rectangular parallelepiped may be cut.

The preparation of the emulsion of high silver chloride content tabular grains having {100} majors faces and a silver chloride content of not less than 50 mol % to be used in the present invention can be accomplished by the method as described in EP 0,534,395A1, U.S. Pat. No. 5,264,337, and Japanese Patent Application No. 5-96250. From the standpoint of stability of preparation and monodispersibility of grain size, the method described in Japanese Patent Application No. 5-96250 is preferred.

1) Nucleation process

Tabular nuclei on which tabular grains grow can be formed at a high production efficiency under conditions such that lattice defects can be induced therein. In order to obtain tabular nuclei with a good reproducibility at a high production efficiency, a method utilizing halogen conversion of produced nuclei can be advantageously used. This method begins with the formation of silver halide nuclei, followed by the introduction of halogen ions which cause the formation of a more difficultly-soluble silver halide to effect halogen conversion.

In some detail, the halogen composition structure of the nucleus formed during nucleation is $(AgX_1|AgX_2)$, $(AgX_1|AgX_4|AgX_3)$ or the like. This structure can be formed, e.g., by a method which comprises adding an aqueous solution of a silver salt and an aqueous solution of a halide by a double jet process so that an incontinuous change is made in the halogen composition of the aqueous solution of a halide. Alternatively, a method can be used which comprises adding an aqueous solution of a halide to a dispersant solution, adding an aqueous solution of a silver salt to the solution to form $AgX_1$, adding an aqueous solution of another halide to the solution, and then adding an aqueous solution of a silver salt to the solution to form an $(AgX_1|AgX_2)$ structure. These methods may be used in combination.

$AgX_1$ differs from $AgX_2$, $AgX_1$ differs from $AgX_4$, and $AgX_2$ differs from $AgX_3$ in $Cl^-$ content or $Br^-$ content by 25 to 100 mol %, preferably 50 to 100 mol %, more preferably 75 to 100 mol %, and/or in $I^-$ content by 5 to 100 mol %, preferably 10 to 100 mol %, more preferably 30 to 100 mol %. In another embodiment, the difference in $Cl^-$ content and $Br^-$ meets the foregoing specification, and the difference in $I^-$ is in the range of 0 to 5 mol %.

The molar ratio $AgX_1$:$AgX_2$ in $(AgX_1|AgX_2)$ and the molar ratio $AgX_1$:$AgX_4$:$AgX_3$ in $(AgX_1|AgX_4|AgX_3)$ may be selected so properly that the optimum embodiment of the present invention can be obtained.

The nucleus grain from which a tabular grain grows preferably has a diameter of not more than 0.15 $\mu$m, more preferably from 0.02 to 0.1 $\mu$m, particularly from 0.01 to 0.1 $\mu$m, as calculated in terms of projected area of circle having the same area as grain.

The dispersant concentration of the dispersant solution during nucleation is preferably from 0.01 to 10% by weight, more preferably from 0.02 to 5% by weight. The pH value of the dispersant solution during nucleation is preferably from 1 to 10, more preferably from 2 to 9. The temperature of the dispersant solution during nucleation is preferably from 10° to 80° C., more preferably from 30° to 60° C. The concentration of excess $Br^-$ during nucleation is preferably not more than $10^{-2}$ mol/l, more preferably not more than $10^{-2.5}$ mol/l. The concentration of excess $Cl^-$ is preferably in the range of 0.8 to 3.0, more preferably 1.2 to 2.8 as calculated in terms of pCl.

In order to allow uniform nucleation, a dispersant may be incorporated in the aqueous solution of a silver salt and/or aqueous solution of a halide. The dispersant concentration is preferably in the range of not less than 0.01% by weight, more preferably from 0.02 to 2% by weight, particularly from 0.05 to 1% by weight. As the dispersant there may be used a low molecular gelatin having a molecular weight of 3,000 to 60,000, preferably 8,000 to 40,000. More preferably, the aqueous solution of a silver salt and the aqueous solution of a halide are directly added to the solution through a porous addition system having 3 to $10^{15}$, preferably 30 to $10^{15}$ pores. For its details, reference can be made to JP-A-3-21339, JP-A-4-193336, and Japanese Patent Application No. 4-240283. The lower the methionine content of gelatin is, the higher is the frequency of formation of defects. The optimum gelatin can be selected from those having a methionine content of 1 to 60 μmol/g depending on the respective circumstances.

The mixing ratio of twin grains can be lowered by reducing the concentration of excess halogen ion or excess silver ion during nucleation.

An aqueous solution of a silver salt and an aqueous solution of a halide are added to a dispersant solution containing at least a dispersant and water with stirring by a double jet process to effect nucleation.

The concentration of $Cl^-$ in the dispersant solution during nucleation is preferably in the range of not more than $10^{-1.5}$ mol/l. The concentration of silver ion in the dispersant solution during nucleation is preferably in the range of not more than $10^{-2}$ mol/l. The pH value of the dispersant solution is preferably in the range of not less than 2, more preferably from 5 to 10. The gelatin concentration is preferably in the range of 0.01 to 3% by weight, more preferably 0.03 to 2% by weight.

The nucleation temperature is not limited. In general, it is preferably in the range of 10° C. to 80° C., more preferably 20° C. to 70° C. The rate at which the aqueous solution of a silver salt is added is preferably in the range of 0.3 to 20 g/min., more preferably 0.5 to 15 g/min. per l of the solution in the vessel. The pH value of the solution in the vessel is not specifically limited. In general, it is in the range of 1 to 11, preferably 3 to 10. The optimum pH value can be selected depending on the combination of excess silver ion concentration, temperature, etc.

In the nucleation process, it is preferred that substantially no $NH_3$ be present in the system. "Substantially no $NH_3$" as defined herein means that the concentration do of the silver halide solvent, $NH_3$, is not more than 0.5 mol/l, preferably less than 0.1 mol/l, more preferably less than 0.02 mol/l . It is also preferred that substantially no silver halide solvents other than $NH_3$ are present in the system during nucleation and growth. "Substantially no silver halide solvents" as defined herein has the same meaning as do. Examples of silver halide solvents other than $NH_3$ include fog inhibitors such as thioethers, thioureas, thiocyanates, organic amine compounds and tetrazaindene compounds. Preferred among these silver halide solvents are thioethers, thioureas, and thiocyanates.

2) Ripening process

It is impossible to prepare tabular grain nucleus alone during nucleation. Therefore, the nucleation process is followed by a ripening process involving Ostwald ripening which allows the growth of tabular grains and the disappearance of other grains. The ripening temperature is not lower than 40° C., preferably from 45° C. to 90° C., more preferably from 50° C. to 80° C.

In the present invention, it is preferred that substantially no silver halide solvents be present in the system also during ripening. The term "substantially no silver halide solvents" is as defined above.

The pH value during ripening is in the range of 1 to 12, preferably 1.5 to 8, more preferably 1.7 to 6.

As the dispersant to be used during nucleation, ripening and growth there may be used any known dispersant for silver halide emulsion. In particular, a gelatin having a methionine content of 0 to 50 μmol/g, more preferably 0 to 30 μmol/g, is preferred. Such a gelatin can be advantageously used for ripening and growth to form thinner tabular grains having a uniform size distribution. Other examples of the dispersant which can be preferably used include synthetic high molecular compounds as disclosed in JP-B-52-16365, and "Bulletin of Society of Photographic Science and Technology of Japan", vol. 29 (1), 17, 22 (1966), vol. 30 (1), 10, 19 (1967), vol. 30 (2), 17 (1967), vol. 33 (3), 24 (1967). Further, a crystal habit controlling agent as disclosed in EP 0534395A1 may be used in combination with the dispersant. The dispersant concentration is preferably in the range of 0.1 to 10% by weight. The amount of the crystal habit controlling agent to be used is preferably in the range of $10^{-1}$ to $10^{-6}$ mol/l, more preferably $10^{-2}$ to $10^{-5}$ mol/l. These materials may be added at any time between before nucleation and completion of growth. These materials may be additionally added to the existing dispersant. Alternatively, these materials may be added to the system after the centrifugal separation of the existing dispersant.

3) Growth process

After the proportion of tabular grains has been raised by ripening, solutes are added to the system to allow the tabular grains to grow further. Examples of the method for adding the solute to the system include (1) a solution addition method (method which comprises the addition of an aqueous solution of a silver salt and an aqueous solution of a halide), (2) a finely divided grain emulsion addition method which comprises the addition of finely divided silver halide grains which have been previously formed, and (3) combination of the two methods. In order to allow tabular grains to grow edgewise preferentially, it is necessary that the tabular grains be allowed to grow in the lowest allowable supersaturation concentration range within which the tabular grains are not subjected to Ostwald ripening. In other words, it is necessary that the low supersaturation concentration is maintained and controlled with a high precision. The method (2) advantageously makes this possible.

In the foregoing finely divided grain emulsion addition method, an emulsion of finely divided silver halide grains having a grain diameter of not more than 0.15 μm, preferably not more than 0.1 μm, more preferably not more than 0.06 μm, is added to the system to effect Ostwald ripening that causes the growth of tabular grains. The addition of the emulsion of finely divided silver halide grains may be effected continuously or intermittently. The emulsion of finely divided grains may be continuously prepared by supplying an aqueous solution of a silver salt and an aqueous solution of a halide into a mixer provided in the vicinity of the reaction vessel, and then immediately supplied continuously into the reaction vessel. Alternatively, the emulsion of finely divided grains may be previously prepared batchwise, and then continuously or intermittently supplied into the reaction vessel. Preferred is the finely divided grains being substantially free of twin grains. The term "substantially free of twin grains" as used herein is meant to indicate that the proportion of twin grains by number is in the range of not more than 5%, preferably not more than 1%, more preferably not more than 0.5%.

The finely divided grains may be in the form of mixed crystal made of two or more halogen compositions such as silver chloride, silver bromide and silver iodide.

The solution conditions under which the grains grow are the same as used in the foregoing ripening process. This is because that both processes involve Ostwald ripening that allows the growth of tabular grains and the disappearance of other grains, and thus are mechanically the same. For the details of the finely divided grain emulsion addition method, reference can be made to Japanese Patent Application Nos. 2-142635 and 4-77261, and JP-A-1-183417.

In order to form finely divided grains substantially free of twinning planes, an aqueous solution of a silver salt and an aqueous solution of a halide may be added in an excess halogen ion concentration or excess silver ion concentration of preferably not more than $10^{-2}$mol/l by a double jet process.

The temperature at which finely divided grains are formed is preferably not higher than 50° C., more preferably from 5° C. to 40° C., more preferably from 10° C. to 35° C. As the dispersant there may be preferably used a gelatin comprising a low molecular gelatin having a molecular weight of preferably 2,000 to $6\times10^4$, more preferably 5,000 to $4\times10^4$, in an amount of preferably not less than 30% by weight, more preferably not less than 60% by weight, particularly not less than 80% by weight. The dispersant concentration is preferably in the range of not less than 0.02% by weight, more preferably from 0.1% by weight to 5% by weight.

Dislocation lines can be introduced into grains during the formation of grains by the halogen composition gap method, halogen conversion method, epitaxial growth method or combination thereof. This advantageously further improves the pressure fog characteristics, reciprocity law characteristics, and color sensitizability. For details, reference can be made to JP-A-63-220238, 64-26839, 2-127635, 3-189642, 3-175440, and 2-123346, EP 0460656A1, and "Journal of Imaging Science", vol. 32, pp. 160–177 (1988).

With the grains thus obtained as host grains, epitaxial grains may be formed. With the grains as core grains, grains having dislocation lines thereinside may be formed. Further, with the grains as substrates, silver halide layers having halogen compositions different from that of the substrates may be deposited to prepare grains having various known grain structures. For details, reference can be made to literatures as described later.

Further, with the tabular grains as cores, a shallow internal latent image emulsion may be formed. Moreover, a core/shell type grain may be formed. For details, reference can be made to JP-A-59-133542, and 63-151618, and U.S. Pat. Nos. 3,206,313, 3,317,322, 3,761,276, 4,269,927, and 3,367,778.

As mentioned above, the most important parameter for eventually obtaining silver halide grains having a high aspect ratio is pAg during ripening and growth.

A silver salt more difficultly-soluble than silver chloride is preferably formed on the surface of high silver chloride content tabular grains having {100} majors faces of the present invention.

Examples of the silver salt more difficultly-soluble than silver chloride include silver bromide, silver iodide, silver bromoiodide, silver thiocyanate, silver selenocyanate, and mixed crystal thereof. Preferred among these silver salts are silver bromide, silver iodide, and silver bromoiodide. The amount of the silver salt more difficultly-soluble than silver chloride is in the range of from not less than 0.001 mol % to not more than 20 mol %, preferably not more than 10 mol %, more preferably not more than 5 mol %, based on the total amount of grains.

As the method for allowing the silver salt more difficultly-soluble than silver chloride to be present on the surface of the tabular grains there may be used a method which comprises the addition of an aqueous solution of a halide having the corresponding composition and an aqueous solution of a silver salt having the corresponding composition by a double jet process, a finely divided grain emulsion addition method, or a method which comprises the use of a bromide ion- or iodide ion-slowly releasing agent.

The method which comprises the addition of an aqueous solution of a halide and a water-soluble silver salt by a double jet process is disadvantageous in that even if the aqueous solution of a halide or the like is added in diluted form, halogen ions must be added in free state, restricting the minimization of intergrain locality. This method finds difficulty particularly in tabular grains. On the other hand, the finely divided grain emulsion addition method or the method which comprises the use of an ion-slowly releasing agent advantageously allows the formation of a salt more difficultly soluble than silver chloride on the surface of grains uniformly from grain to grain.

In the finely divided grain emulsion addition method, the average diameter of the grains in sphere equivalent is preferably in the range of not more than 0.1 μm, more preferably not more than 0.06 μm. The emulsion of finely divided grains may be continuously prepared by supplying an aqueous solution of a silver salt and an aqueous solution of salt capable of forming a silver salt having a low solubility than silver chloride into a mixer provided in the vicinity of the reaction vessel, and then immediately supplied into the reaction vessel. Alternatively, the emulsion of finely divided grains may be previously prepared batchwise, and then supplied into the reaction vessel. The method which comprises the use of an ion-releasing agent is disclosed in JP-B-1-285942, and JP-A-6-11780.

As protective colloid to be used in the preparation of the emulsion of the present invention or binder to be incorporated in other hydrophilic colloidal layers there may be advantageously used gelatin. Other hydrophilic colloids can be used.

For example, proteins such as gelatin derivative, graft polymer of gelatin and other high molecular compounds, albumin and casein, cellulose derivatives such as hydroxyethyl cellulose, carboxymethyl cellulose and cellulose sulfuric ester, saccharide derivatives such as sodium alginate and starch derivative, and various synthetic hydrophilic high molecular compounds such as homopolymer and copolymer, e.g., polyvinyl alcohol, polyvinyl alcohol partial acetal, poly-N-vinyl pyrrolidone, polyacrylic acid, polymethacrylic acid, polyacrylamide, polyvinyl imidazole, and polyvinyl pyrazole.

As gelatin there may be used lime-treated gelatin as well as acid-treated gelatin or enzyme-treated gelatin as described in Bull. Soc. Sci. Photo. Japan. No. 16, page 30, 1966. Further, a hydrolyzate of gelatin or product of enzymatic decomposition of gelatin may be used.

The emulsion of the present invention is preferably rinsed for desalting to form a newly prepared protective colloid dispersion. The rinsing temperature can be selected depending on the purpose and is preferably from 5° C. to 50° C. The pH value during rinsing can be selected depending on the purpose and is preferably from 2 to 10, more preferably 3 to 8. The pAg value during rinsing can be selected depending on the purpose and is preferably from 5 to 10. As the rinsing process there can be selected from noodle rinsing, dialysis process using a diaphragm, centrifugal separation process, coagulation sedimentation process and ion exchanging process. As coagulation sedimentation process there can be selected from sulfate process, organic solvent process, water-soluble-polymer process and gelatin derivative process.

A salt of metallic ion is preferably allowed to be present in the system during the preparation of the emulsion, e.g., during the formation, desalting or chemical sensitization of grains or before the application thereof, depending on the purpose. When the grains are doped with such a metallic salt, it is preferably added to the system during the formation of the grains. When such a metallic ion is used to modify the surface of the grains or as a chemical sensitizer, it is preferably added to the system between after the formation of the grains and before the chemical sensitization thereof. Examples of the metal employable in the present invention include Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, and Bi. These metals may be used in the form of salt which can be dissolved in the emulsion during the formation of grains, such as ammonium salt, acetate, nitrate, sulfate, phosphate, hydroxide, six-coordinate complex and four-coordinate complex. Examples of these salts include metallic compounds such as $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$ and $K_4Ru(CN)_6$. As the ligand of these coordination compounds there can be selected from the group consisting of halo, aco, cyano, cyanate, thiocyanate, nitrosyl, oxo, and carbonyl. These metallic compounds may be used singly. Alternatively, two or more of these metallic compounds may be used in combination.

Such a metallic compound is preferably added to the emulsion in the form of solution in a proper solvent such as water, methanol and acetone. In order to stabilize the solution, a method may be used which comprises the use of an aqueous solution of hydrogen halide (e.g., HCl HBr) or alkali halide (e.g., KCl NaCl, KBr, NaBr). An acid or alkali may be added to the solution as necessary. The foregoing metallic compound may be charged into the reaction vessel before the formation of grains or may be added to the emulsion during the formation of grains. Alternatively, the metallic compound may be added to a water-soluble silver salt (e.g., $AgNO_3$) or aqueous solution of alkali halide (e.g., NaCl, KBr, KI) which is then continuously added to the emulsion during the formation of silver halide grains. Further, the metallic compound may be prepared separately of the water-soluble silver salt or alkali halide in the form of solution which is then continuously added to the emulsion at any proper time during the formation of grains. Moreover, these various addition methods may be used in combination.

The method which comprises the addition of a chalcogenide compound as described in U.S. Pat. No. 3,772,031 may be optionally used. Besides S, Se and Te, cyanates, thiocyanates, selenocyanic acid, carbonates, phosphates and acetates may be present in the system.

The base grains of the present invention may be subjected to at least one of sulfur sensitization, selenium sensitization, gold sensitization, palladium sensitization, sensitization with other noble metals, and reduction sensitization at any step during the preparation of the silver halide emulsion. It is preferred that two or more of these sensitization methods be used in combination. Various types of emulsions can be prepared by varying the step at which chemical sensitization is effected. Examples of these types of emulsions include a type of emulsion having a chemically sensitized nucleus embedded in grain, a type of emulsion having a chemically sensitized nucleus embedded shallow in grain, and a type of emulsion having a chemically sensitized nucleus formed on the surface of grain. The position at which the chemically sensitized nucleus is present in the emulsion of the present invention may be selected depending on the purpose. In a preferred embodiment, at least a kind of chemically sensitized nucleus is formed in the vicinity of the surface of grain.

One of chemical sensitization methods which can be preferably effected is chalcogenide sensitization method or noble metal sensitization method or combination thereof. The chemical sensitization can be effected with active gelatin as disclosed in T. H. James, "The Theory of the Photographic Process", 4th ed., Macmillan, 1977, pp. 67–76. The chemical sensitization can also be effected with sulfur, selenium, tellurium, gold, platinum, palladium or iridium or combination thereof at pAg 5 to 10, pH 5 to 8 and a temperature of 30° to 80° C. as disclosed in Research Disclosure, vol. 120, April 1974, 12008, Research Disclosure, vol. 34, June 1975, 13452, U.S. Pat. Nos. 2,642,361, 3,297,446, 3,772,031, 3,857,711, 3,901,714, 4,266,018, and 3,904,415, and British Patent 1,315,755. The noble metal sensitization may be effected with a noble metal such as gold, platinum, palladium and iridium. Particularly preferred among these noble metal sensitization methods are gold sensitization, palladium sensitization, and combination thereof. The gold sensitization method may be effected with a known compound such as chloroauric acid, potassium chloroaurate, potassium aurithiocyanate, gold sulfide and gold selenide. The palladium compound means a divalent or tetravalent palladium salt. A preferred palladium compound is represented by $R_2PdX_6$ or $R_2PdX_4$ wherein R represents a hydrogen atom, alkaline metal atom or ammonium group, and X represents a halogen atom such as chlorine atom, bromine atom and iodine atom.

In some detail, $K_2PdCl_4$, $(NH_4)_2PdCl_6$, $Na_2PdCl_4$, $(NH_4)_2PdCl_4$, $Li_2PdCl_4$, $Na_2PdCl_6$ or $K_2PdBr_4$ is preferred. The gold compound and palladium compound are preferably used in combination with a thiocyanate or selenocyanate.

As the sulfur sensitizer there may be used hypo, thiourea compound, rhodanine compound or sulfur-containing compound as disclosed in U.S. Pat. Nos. 3,857,711, 4,226,018 and 4,054,457. The chemical sensitization method can be effected in the presence of a so-called chemical sensitizing aid. As such a chemical sensitizing aid there may be used a compound which inhibits fogging during chemical sensitization and enhances sensitivity, e.g., azaindene, azapyridazine and azapyrimidine. Examples of chemical sensitizing aid improvers are described in U.S. Pat. Nos. 2,131,038, 3,411,914, 3,554,757, JP-A-58-126526, and Duffin, "Chemistry of Photographic Emulsion", pp. 138–143.

The emulsion of the present invention is preferably subjected to gold sensitization as well. The optimum amount of gold sensitizer is in the range of $1\times10^{-4}$ to $1\times10^{-7}$ mol, preferably $1\times10^{-5}$ to $5\times10^{-7}$ mol. The optimum amount of palladium compound is in the range of $1\times10^{-3}$ to 5×10–7 mol. The optimum amount of thiocyanic compound or selenocyanic compound is in the range of $5\times10^{-2}$ to $1\times10^{-6}$. The optimum amount of sulfur sensitizer to be used for silver halide grains of the present invention is in the range of $1\times10^{-4}$ to $1\times10^{-7}$ mol, preferably $1\times10^{-5}$ to $5\times10^{-7}$ mol per mol of silver halide.

The optimum sensitization method to which the emulsion of the present invention is subjected is selenium sensitization. The selenium sensitization method may be effected with a known instable selenium compound. In some detail, selenium compounds such as colloidal metallic selenium, selenourea (e.g., N,N-dimethylselenourea, N,N-diethylselenourea), selenoketone and selenoamide can be used.

The selenium sensitization method may be optionally effected in combination with sulfur sensitization or noble metal sensitization or combination thereof.

The silver halide emulsion according to the present invention is preferably subjected to reduction sensitization during grain formation, between after grain formation and before chemical sensitization, during chemical sensitization or after chemical sensitization.

As reduction sensitization there can be selected from a process which comprises the addition of a reduction sensitizer to a silver halide emulsion, a process called silver ripening which comprises allowing silver halide grains to grow or ripening silver halide grains in an atmosphere of pAg as low as 1 to 7, and a process called high pH ripening which comprises allowing silver halide grains to grow or ripening silver halide grains in an atmosphere of pH as high as 8 to 11. Two or more of these processes may be used in combination.

The foregoing process involving the addition of a reduction sensitizer is advantageous in that the level of reduction sensitization can be closely controlled.

As reduction sensitizers there have been known stannous salts, ascorbic acid and derivatives thereof, amines, polyamines, hydrazine derivative, formamidinesulfinic acid, silane compounds, and borane compounds. As the reduction sensitizer employable in the present invention there can be selectively used any of these known reduction sensitizers. Two or more of these compounds may be used in combination. Preferred examples of reduction sensitizers employable in the present invention stannous chloride, thiourea dioxide, dimethylamineborane, and ascorbic acid and derivatives thereof. The amount of the reduction sensitizer to be added in the present invention needs to be selected depending on the production conditions of emulsion and is preferably from $10^{-7}$ mol to $10^{-3}$ mol per mol of silver halide.

The reduction sensitizer may be added to the system in the form of solution in a solvent such as water, alcohol, glycol, ketone, ester and amide during the growth of grains. The reduction sensitizer may be previously added to the system in the reaction vessel. Preferably, it is added to the system at any proper time during the growth of silver halide grains. Alternatively, the reduction sensitizer may be previously added to an aqueous solution of a water-soluble silver salt or water-soluble alkali halide which is then subjected to precipitation of silver halide grains. In another preferred example, the reduction sensitization solution may be added to the system in several batches or in a continuous manner for a prolonged period of time with the progress of growth of silver halide grains.

A silver oxidizing agent is preferably used during the preparation of the emulsion of the present invention. The term "silver oxidizing agent" as used herein means a compound which acts on metallic silver to convert it to silver ion. In particular, a compound which converts extremely minute silver grains by-produced during the formation and chemical sensitization of silver halide grains to silver ions is useful. The silver ions produced during this process may form a silver salt difficultly soluble in water, such as silver halide, silver sulfate and silver selenide or a silver salt easily soluble in water, such as silver nitrate. The silver oxidizing agent may be an inorganic or organic compound. Examples of the inorganic oxidizing agent include ozone, hydrogen peroxide, adducts thereof (e.g., $NaBO_2.H_2O_2.3H_2O$ , $2NaCO_3.3H_2O_2$, $Na_4P_2O_7.\ 2H_2O_2$, $2Na_2SO_4.H_2O_2$), peroxy acid salts (e.g., $K_2S_2O_8$, $K_2C_2O_6$, $K_2P_2O_8$), peroxy complex compounds (e.g., $K_2[Ti(O_2)C_2O_4].3H_2O$, $4K_2SO4.Ti(O_2)OH.SO_4.2H_2O$ $Na_3[VO(O_2)(C_2H_4)_2].6H_2O$), oxygen acid salts such as permanganate (e.g., $KMnO_4$) and chromate (e.g., $K_2Cr_2O_7$), halogen elements such as iodine and bromine, perhalogenates (e.g., potassium periodate), salts of metal having a high valency (e.g., potassium ferric hexacyanoate), and thiosulfonates.

Examples of the organic oxidizing agent include quinones such as p-quinone, organic peroxides such as peracetic acid and perbenzoic acid, and compounds which release active halogen (e.g., N-bromosuccimide, chloramine T, Chloramine B).

Preferred among these oxidizing agents are inorganic oxidizing agents such as ozone, hydrogen peroxide and adducts thereof, halogen elements and thiosulfonates, and organic oxidizing agents such as quinone. In a preferred embodiment, the foregoing reduction sensitization method is effected in combination with the use of the foregoing silver oxidizing agent. The use of the oxidizing agent may be followed by the reduction sensitization, or vice versa, or may be effected at the same time with the reduction sensitization. These methods may be selectively effected at the grain formation process or chemical sensitization process.

The photographic emulsion to be used in the present invention can comprise various compounds for the purpose of inhibiting fogging during the preparation, storage or photographic processing of the light-sensitive material or stabilizing the photographic properties. In particular, there can be used many compounds known as fog inhibitors or stabilizers. Examples of these fog inhibitors or stabilizers include thiazoles such as benzothiazolium salt, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (particularly 1-phenyl-5-mercaptotetrazole), mercaptopyrimidines, mercaptotriazines, thioketo compounds such as oxadolinethione, azaindenes such as triazaindenes, tetraazaindenes (particularly 4-hydroxy-substituted (1,3,3a,7) tetraazaindenes), and pentaazaindenes. For example, those described in U.S. Pat. Nos. 3,954,474, and 3,982,947, and JP-B-52-28660 can be used. These fog inhibitors and stabilizers may be added at any time before, during and after the formation of grain, during rinsing, during dispersion after rinsing, before, during and after chemical sensitization, and before coating depending on the purpose. One of preferred compounds includes that disclosed in JP-A-63-212932. These fog inhibitors and stabilizers can exert the inherent effect of inhibiting fog and stabilizing the emulsion when added during the preparation of the emulsion as well as many other effects, i.e., controlling the crystal habit of grain, chemical sensitization and dye arrangement, reducing the grain size and the grain solubility, etc.

As the spectral sensitizing dye to be adsorbed to the base grains of the present invention there may be used a methine dye. Accordingly, the photographic emulsion which has been eventually obtained can be advantageously subjected to spectral sensitization with a methine dye or other dyes to exert the effects of the present invention. Examples of a spectral sensitizing dye to be used in the present invention include cyanine dye, melocyanine dye, composite cyanine dye, composite melocyanine dye, holopolar cyanine dye, hemicyanine dye, styryl dye, and hemioxonol dye. Particularly useful among these dyes are cyanine dye, melocyanine dye, and composite melocyanine dye. Any of nuclei which are commonly used as basic heterocyclic nuclei for cyanine dyes can be applied to these dyes. Examples of suitable nuclei which can be applied to these dyes include pyrroline nucleus, oxazoline nucleus, thiazoline nucleus, pyrrole nucleus, oxazole nucleus, thiazole nucleus, selenzazole nucleus, imidazole nucleus, tetrazole nucleus, pyrridine nucleus, and nucleus obtained by fusion of alicyclic hydrocarbon rings to these nucleus or nucleus obtained by fusion of aromatic hydrocarbon rings to these groups, e.g., indolenine nucleus, benzindolenine nucleus, indole nucleus, benzoxazole nucleus, naphthooxazole nucleus, benzothiazole nucleus, naphthothiazole nucleus, benzoselenazole nucleus, benzimidazole nucleus and quinoline nucleus. These nuclei may contain substituents on carbon atoms.

Examples of suitable nuclei which can be applied to melocyanine dye or composite melocyanine dye include those having a ketomethylene structure such as 5- or 6-membered heterocyclic nucleus, e.g., pyrazoline-5-one nucleus, thiohydantoin nucleus, 2-thiooxazolidine-2,4-dione nucleus, thiazolidine-2,4-dione nucleus, rhodanine nucleus, and thiobarbituric acid nucleus.

These sensitizing dyes can be used singly or in combination. In particular, a combination of sensitizing dyes is often used for the purpose of supersensitization. Typical examples of such a combination are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, British Patents 1,344,281, and 1,507,803, JP-B-43-4936, and 53-12375, and JP-A-52-110618, and 52-109925.

In combination with these sensitizing dyes, a dye which doesn't exhibit a spectral sensitizing effect itself or a substance which doesn't substantially absorb visible light but exhibits a supersensitizing effect can be incorporated in the emulsion.

The optimum time at which the spectral sensitizing dye is added to the emulsion is between after the formation of base grains and before the addition of finely divided grains. In general, it may be added between the completion of chemical sensitization and the coating. As described in U.S. Pat. Nos. 3,628,969, and 4,225,666, it may be added at the same time with the chemical sensitizer to effect spectral sensitization and chemical sensitization at the same time. Alternatively, as described in JP-A-58-113928, it may be added before the chemical sensitization or it may be added before the completion of the precipitation of silver halide grains to initiate the spectral sensitization. Further, as taught in U.S. Pat. No. 4,225,666, the above mentioned compound may be added batchwise, that is, part of the compound may be added before the chemical sensitization and the rest of the compound may be added after the chemical sensitization. As taught in U.S. Pat. Nos. 4,183,756, it may be added at any stage during the formation of silver halide grains.

The added amount of the sensitizing dye is in the range of $4\times10^{-6}$ to $8\times10^{-3}$ mol per mol of silver halide. For silver halide grains having a size of 0.2 to 1.2 $\mu$m which is preferred in the present invention, it is preferably in the range of about $5\times10^{-5}$ to $2\times10^{-3}$ mol per mol of silver halide.

When applied to photographic light-sensitive materials, the emulsion obtained according to the present invention may comprise the foregoing various additives as well as other various additives depending on the purpose.

These additives are further described in Research Disclosure Item 17643 (December 1978), Item 18716 (November 1979), and Item 308119 (December 1989). The places where these additives are described in these references will be tabulated in Table 1 below.

| Kind of additive | RD17643 | RD18716 | RD308119 |
|---|---|---|---|
| 1. Chemical sensitizer | p. 23 | p. 648 right column (RC) | p. 996 |
| 2. Sensitivity increasing agent | | p. 23 column (RC) | |
| 3. Spectral sensitizer and supersensitizer | pp. 23–24 | p. 648 RC–p. 649 RC | p. 996 RC–p. 998 RC |
| 4. Brightening agent | p. 24 | | p. 998 RC |
| 5. Antifoggant and stabilizer | pp. 24–25 | p. 649 RC | p. 998 RC p. 1000 RC |
| 6. Light absorbent, filter dye, and ultraviolet absorbent | pp. 25–26 | p. 649 RC–p. 650 LC left column (LC) | P. 1003 LC–P. 1003 RC |
| 7. Stain inhibitor | p. 25 RC | p. 650 LC–RC | P. 1002 RC |
| 8. Dye image stabilizer | p. 25 | | do. |
| 9. Hardening agent | p. 26 | p. 651 LC | P. 1004 RC–P. 1005 LC |
| 10. Binder | p. 26 | " | P. 1003 RC–P. 1004 RC |
| 11. Plasticizer and lubricant | p. 27 | p. 650 RC | P. 1006 LC–RC |
| 12. Coating aid and surface active agent | pp. 26–27 | " | P. 1005 LC–P. 1006 LC |
| 13. Antistatic agent | p. 27 | " | P. 1006 RC–P. 1007 LC |
| 14. Matting agent | | | P. 1008 LC–P. 1009 LC |

The present photographic light-sensitive material can comprise at least one blue-sensitive layer comprising a silver halide grains of the present invention, at least one green-sensitive layer comprising a silver halide grains of the present invention and at least one red-sensitive layer comprising a silver halide grains of the present invention on a support. The number of silver halide emulsion layers and light-insensitive layers and the order of arrangement of these layers are not specifically limited. In a typical embodiment, the present silver halide photographic material comprises light-sensitive layers consisting of a plurality of silver halide emulsion layers having substantially the same color sensitivity and different light sensitivities on a support. The light-sensitive layers are unit light-sensitive layers having a color sensitivity to any of blue light, green light and red light. In the multi-layer silver halide color photographic material, these unit light-sensitive layers are normally arranged in the order of red-sensitive layer, green-sensitive layer and blue-sensitive layer as viewed from the support. However, the order of arrangement can be optionally reversed depending on the purpose of application. Alternatively, two unit light-sensitive layers having the same color sensitivity can be arranged with a unit light-sensitive layer having a different color sensitivity interposed therebetween.

In the photographic light-sensitive material of the present invention, the blue-sensitive silver halide emulsion layer and/or green-sensitive emulsion layer preferably comprises a silver halide emulsion of the present invention.

Light-insensitive layers such as various interlayers can be provided between these silver halide light-sensitive layers and on the uppermost layer and lowermost layer.

These interlayers can comprise couplers, DIR compounds or the like as described in JP-A-61-43748, JP-A-59-113438, JP-A-59-113440, JP-A-61-20037 and JP-A-61-20038. These interlayers can further comprise a color mixing inhibitor as commonly used.

The plurality of silver halide emulsion layers constituting each unit light-sensitive layer can be preferably in a two-layer structure, i.e., high sensitivity emulsion layer and low sensitivity emulsion layer, as described in West German Patent 1,121,470 and British Patent 923,045. In general, these layers are preferably arranged in such an order that the light sensitivity becomes lower towards the support. Furthermore, a light-insensitive layer can be provided between these silver halide emulsion layers. As described in JP-A-57-112751, JP-A-62-200350, JP-A-62-206541, and JP-A-62-206543, a low sensitivity emulsion layer can be provided remote from the support while a high sensitivity emulsion layer can be provided nearer to the support.

In an embodiment of such an arrangement, a low sensitivity blue-sensitive layer (BL), a high sensitivity blue-sensitive layer (BH), a high sensitivity green-sensitive layer (GH), a low sensitivity green-sensitive layer (GL), a high sensitivity red-sensitive layer (RH), and a low sensitivity red-sensitive layer (RL) can be arranged in this order remote from the support. In another embodiment, BH, BL, GL, GH, RH, and RL can be arranged in this order remote from the support. In a further embodiment, BH, BL, GH, GL, RL, and RH can be arranged in this order remote from the support.

As described in JP-B-55-34932 (The term "JP-B" as used herein means an "examined Japanese patent publication"), blue-sensitive layer, GH, RH, GL, and RL can be arranged in this order remote from the support. Alternatively, as described in JP-A-56-25738 and JP-A-62-63936, a blue-sensitive layer, GL, RL, GH, and RH can be arranged in this order remote from the support.

As described in JP-B-49-15495, a layer arrangement can be used such that the uppermost layer is a silver halide emulsion layer having the highest sensitivity, the middle layer is a silver halide emulsion layer having a lower sensitivity, and the lowermost layer is a silver halide emulsion layer having a lower sensitivity than that of the middle layer. In such a layer arrangement, the light sensitivity becomes lower towards the support. Even if the layer structure comprises three layers having different light sensitivities, a middle sensitivity emulsion layer, a high sensitivity emulsion layer and a low sensitivity emulsion layer can be arranged in this order remote from the support in a color-sensitive layer as described in JP-A-59-202464.

Alternatively, a high sensitivity emulsion layer, a low sensitivity emulsion layer and a middle sensitivity emulsion layer or a low sensitivity emulsion layer, a middle sensitivity emulsion layer and a high sensitivity emulsion layer may be arranged in this order.

In the case of four-layer structure, too, the arrangement of layers may be similarly altered.

As described above, various layer structures and arrangements can be selected depending on the purpose of light-sensitive material.

In the photographic light-sensitive material of the present invention, at least one silver halide emulsion layer provided on a support comprises a silver halide emulsion of the present invention in an amount of from 30% to 100%, preferably from 50% to 100%, more preferably from 70% to 100%.

The silver halide composition other than the silver halide of the present invention to be incorporated in the photographic emulsion layer in the photographic light-sensitive material of the present invention preferably comprises silver bromoiodide, silver chloroiodide or silver bromochloroiodide having a silver iodide content of from about 0.01 to about 30 mol %. Silver bromoiodide or silver bromochloroiodide having a silver iodide content of from about 2 mol % to about 10 mol % is most preferred. However, the total content of silver bromide in the light-sensitive material is preferably low, and so is the silver iodide content.

Silver halide grains in the present invention emulsions may be so-called regular grains having a regular crystal form, such as cube, octahedron and tetradecahedron, or those having an irregular crystal form such as sphere and tablet, those having a crystal defect such as twinning plane, or those having a combination of these crystal forms.

The silver halide grains other than the silver halide composition of the present invention may be either fine grains of about 0.2 μm or smaller in diameter or giant grains having a projected area diameter of up to about 10 μm. The emulsion may be either a monodisperse emulsion or a polydisperse emulsion.

The silver halide emulsion of the present invention is normally subjected to physical ripening, chemical ripening and spectral sensitization before use which methods therefor are the same as described before for high silver chloride {100} tabular grains. Various additives other than those disclosed above may be used depending on the purpose in the same way as in the high silver chloride {100} tabular grains described above.

In the light-sensitive material of the present invention, two or more kinds of light-sensitive halide emulsions which are different in at least one of grain size, grain size distribution, halogen composition, grain shape and sensitivity may be incorporated in the same layer in admixture.

Surface-fogged silver halide grains as described in U.S. Pat. No. 4,082,553, internally-fogged silver halide grains as described in U.S. Pat. No. 4,626,498 and JP-A-59-214852, or colloidal silver may be preferably incorporated in a light-sensitive silver halide emulsion layer and/or substantially light-insensitive hydrophilic colloidal layer. The term "internally- or surface-fogged silver halide grains" as used herein means "silver halide grains which can be uniformly (nonimagewise) developed regardless of whether they were present in the exposed portion or unexposed portion on the light-sensitive material". Processes for the preparation of internally- or surface-fogged silver halide grains are described in U.S. Pat. No. 4,626,498, and JP-A-59-214852.

Silver halides forming the core of internally-fogged core/shell type silver halide grains may have the same or different halogen compositions. Internally- or surface-fogged silver halide grains may comprise any of silver chloride, silver bromochloride, silver bromoiodide and silver bromochloroiodide. The size of these fogged silver halide grains is not specifically limited, and its average grain size is preferably in the range of 0.01 to 0.75 μm, particularly 0.05 to 0.6 μm. The form of these grains is not specifically limited and may be regular. These emulsions may be polydisperse but is preferably monodisperse (silver halide grains at least 95% by weight or number of which are those having grain diameters falling within ± 40% from the average grain size).

In the present invention, light-insensitive finely divided silver halide grains are preferably used. Light-sensitive finely divided silver halide grains are silver halide grains which are not sensitive to light upon imagewise exposure for taking of dye images so that they are not substantially developed at development process. Preferably, these silver halide grains are not previously fogged.

These finely divided silver halide grains have a silver bromide content of 0 to 100 mole % and may optionaly contain silver chloride and/or silver iodide, preferably 0.5 to 10 mole % of silver iodide.

These finely divided silver halide grains preferably have an average diameter of 0.01 to 0.5 μm, more preferably 0.02 to 0.2 μm as calculated in terms of diameter of circle having the same area as the projected area of grain.

These finely divided silver halide grains can be prepared in the same manner as ordinary light-sensitive silver halide. In this case, the surface of the silver halide grains needs neither chemically nor spectrally be sensitized. However, prior to the addition of the emulsion to a coating solution, a known additive such as triazole, azaindene, benzothiazolium or mercapto compound and zinc compound is preferably added to the emulsion. Colloidal silver is preferably incorporated in the layer containing these finely divided silver halide grains.

The coated amount of silver in the light-sensitive material of the present invention is preferably in the range of from 1.0 to 10.0 g/m$^2$, more preferably from 2.0 to 8.0 g/m$^2$, most preferably from 2.0 to 5.0 g/m$^2$.

Known photographic additives which can be used in the present invention are also described in the above cited three Research Disclosures as tabulated in Table 1 later.

In order to inhibit deterioration in photographic properties due to formaldehyde gas, a compound capable of reacting with and solidifying formaldehyde as disclosed in U.S. Pat. Nos. 4,411,987 and 4,435,503 can be incorporated in the light-sensitive material.

The light-sensitive material of the present invention preferably comprises a mercapto compound as disclosed in U.S. Pat. Nos. 4,740,454, and 4,788,132, and JP-A-62-18539, and 1-283551.

The light-sensitive material of the present invention preferably contains a fogging agent, a development accelerator, a silver halide solvent or a compound for releasing precursors thereof as disclosed in JP-A-1-106052 regardless of the amount of developed silver produced by development.

The light-sensitive material of the present invention preferably comprises a dye which has been dispersed by a method as disclosed in International Patent Disclosure W088/04794 and JP-A-1-502912 or a dye as disclosed in EP317,308 A, U.S. Pat. No. 4,420,555, and JP-A-1-259358.

The light-sensitive material to be processed in the present invention can comprise various color couplers. Specific examples of the color couplers are described in the patents described in the above cited Research Disclosure No. 17643, VII-C to G, and No. 307105, VII-C to G.

Preferred yellow couplers include those described in U.S. Pat. Nos. 3,933,501, 4,022,620, 4,326,024, 4,401,752, 4,248,961, 3,973,968, 4,314,023, and 4,511,649, JP-B-58-10739, British Patents 1,425,020 and 1,476,760, and EP 249,473A.

Preferred magenta couplers include 5-pyrazolone compounds and pyrazoloazole compounds. Particularly preferred are those described in U.S. Pat. Nos. 4,310,619, 4,351,897, 3,061,432, 3,725,067, 4,500,630, 4,540,654, and 4,556,630, European Patent 73,636, JP-A-60-33552, 60-43659, 61-72238, 60-35730, 55-118034, and 60-185951, RD Nos. 24220 (June 1984) and 24230 (June 1984), and W088/04795.

Cyan couplers include naphthol and phenol couplers. Preferred are those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, 4,327,173, 3,446,622, 4,333,999, 4,775,616, 4,451,559, 4,427,767, 4,690,889, 4,254,212, and 4,296,199, West German Patent Laid Open No. 3,329,729, European Patents 121,365A and 249,453A, and JP-A-61-42658.

Typical examples of polymerized dye-forming couplers are described in U.S. Pat. Nos. 3,451,820, 4,080,211, 4,367,282, 4,409,320, and 4,576,910, British Patent 2,102,173, and European Patent 341,188A.

Couplers which form a dye having moderate diffusibility preferably include those described in U.S. Pat. No. 4,366,237, British Patent 2,125,570, European Patent 96,570, and West German Patent Publication (Laid Open) No. 3,234,533.

Colored couplers for correction of unnecessary absorptions of the developed dye preferably include those described in Research Disclosure No. 17643, VII-G, Research Disclosure No. 307105, VII-G, U.S. Pat. Nos. 4,163,670, 4,004,929, and 4,138,258, JP-B-57-39413, and British Patent 1,146,368. Furthermore, couplers for correction of unnecessary absorption of the developed dye by a fluorescent dye released upon coupling as described in U.S. Pat. No. 4,774,181 and couplers containing as a separatable group a dye precursor group capable of reacting with a developing agent to form a dye as described in U.S. Pat. No. 4,777,120 can be preferably used.

Compounds capable of releasing a photographically useful residue upon coupling can also be used in the present invention. Preferred examples of DIR couplers which release a development inhibitor are described in the patents cited in RD 17643, VII-F, RD 307105, VII-F, JP-A-57-151944, 57-154234, 60-184248, 63-37346, and 63-37350, and U.S. Pat. Nos. 4,248,962, and 4,782,012.

Couplers capable of imagewise releasing a nucleating agent or a developing accelerator at the time of development preferably include those described in British Patents 2,097,140 and 2,131,188, and JP-A-59-157638 and 59-170840. Further, compounds which undergo redox reaction with the oxidation product of a developing agent to release a fogging agent, a development accelerator, a silver halide solvent or the like as disclosed in JP-A-60-107029, 60-252340, 1-44940, and 1-45687 are preferred.

In addition to the foregoing couplers, the photographic material according to the present invention can further comprise competing couplers as described in U.S. Pat. No. 4,130,427, polyequivalent couplers as described in U.S. Pat. Nos. 4,283,472, 4,338,393, and 4,310,618, DIR redox compound- or DIR coupler-releasing coupler, DIR coupler-releasing redox compound or DIR redox-releasing redox compound as described in JP-A-60-185950 and 62-24252, couplers capable of releasing a dye which returns to its original color after release as described in European Patents 173,302A and 313,308A, bleach accelerator-releasing couplers as described in R.D. Nos. 11449 and 24241, couplers capable of releasing a ligand as described in U.S. Pat. No. 4,555,477, couplers capable of releasing a leuco dye as described in JP-A-63-75747, and couplers capable of releasing a fluorescent dye as described in U.S. Pat. No. 4,774,181.

In the present invention, two-equivalent couplers or four-equivalent couplers may be used. It is preferred that two-equivalent couplers be used in an amount of 100%.

The incorporation of the couplers of the present invention in the light-sensitive material can be accomplished by any suitable known dispersion method.

Examples of high boiling solvents to be used in the oil-in-water dispersion process are described in U.S. Pat. No. 2,322,027.

Specific examples of high boiling organic solvents having a boiling point of 175° C. or higher at normal pressure which can be used in the oil-in-water dispersion process include phthalic esters (e.g., dibutyl phthalate, dicyclohexyl phthalate, di-2-ethylhexyl phthalate, decyl phthalate, bis(2,4-di-t-amylphenyl)phthalate, bis(2,4-di-t-amylphenyl) isophthalate, bis($1_{,1}$-diethylpropyl)phthalate), phosphoric or phosphonic esters (e.g., triphenyl phosphate, tricresyl phosphate, 2-ethylhexyl diphenyl phosphate, tricyclohexyl phosphate, tri-2-ethylhexyl phosphate, tridodecyl phosphate, tributoxy ethyl phosphate, trichloropropyl phosphate, di-2-ethylhexyl phenyl phosphonate), benzoic esters (e.g., 2-ethylhexyl benzoate, dodecyl benzoate, 2-ethylhexyl-p-hydroxy benzoate), amides (e.g., N,N-diethyldodecanamide, N,N-diethyllaurylamide, N-tetradecylpyrrolidone), alcohols or phenols (e.g., isostearyl alcohol, 2,4-di-tert-amylphenol), aliphatic carboxylic esters (e.g., bis(2-ethylhexyl)sebacate, dioctyl azerate, glycerol tributylate, isostearyl lactate, trioctyl citrate), aniline derivatives (e.g., N,N-dibutyl-2-butoxy-5-tert-octylaniline), and hydrocarbons (e.g., paraffin, dodecylbenzene, diisopropyl naphthalene). As an auxiliary solvent there can be used an organic solvent having a boiling point of about 30° C. or higher, preferably 50° C. to about 160° C. Typical examples of such an organic solvent include ethyl acetate, butyl acetate, ethyl propionate, methyl ethyl ketone, cyclohexanone, 2-ethoxyethyl acetate, and dimethylformamide.

The process and effects of latex dispersion method and specific examples of latexes to be used in dipping are described in U.S. Pat. No. 4,199,363, West German Patent Application (OLS) 2,541,274, and 2,541,230.

The photographic light-sensitive material of the present invention preferably comprises various antiseptics or antifungal agents such as phenetyl alcohol and 1,2-benzisothiazoline-3-one, n-butyl-p-hydroxybenzoate, phenol, 4-chloro-3,5-dimethylphenol, 2-phenoxyethanol and 2-(4-thiazolyl)benzimidazole as described in JP-A-63-257747, 62-272248 and 1-80941.

The present invention is applicable to various types of photographic light-sensitive materials, particularly preferably to color negative films for common use or motion picture, color reversal films for slide or television, color papers, color positive films and color reversal papers. Particularly preferred among these photographic light-sensitive materials to which the present invention is applied are color negative films for common use.

Suitable supports which can be used in the present invention are described in the above cited RD 17643 (page 28), No. 18716 (right column on page 647 to left column on page 648), and No. 307105 (page 879).

In the present light-sensitive material, the total thickness of all hydrophilic colloidal layers on the emulsion side is preferably in the range of from 10 μm to 28 μm, more preferably from 10 μm to 23 μm, further preferably from 11 μm to 18 μm, particularly from 12 μm to 16 μm. The film swelling $T_{1/12}$ is preferably in the range of 30 seconds or less, more preferably 20 seconds or less. In the present invention, the film thickness is determined after being stored at a temperature of 25° C. and a relative humidity of 55% for 2 days. The film swelling $T_{1/2}$ can be determined by a method known in the art, e.g., by means of a swellometer of the type as described in A. Green et al., "Photographic Science and Engineering", vol. 19, No. 2, pp. 124–129. $T_{1/12}$ is defined as the time taken until half the saturated film thickness is reached wherein the saturated film thickness is 90% of the maximum swollen film thickness reached when the light-sensitive material is processed with a color developer at a temperature of 38° C. over 195 seconds.

The film swelling $T_{1/122}$ can be adjusted by adding a film hardener to gelatin as binder or altering the ageing condition after coating. The percentage swelling of the light-sensitive material is preferably in the range of 150 to 400%. The percentage swelling can be calculated from the maximum swollen film thickness determined as described above in accordance with the equation: (maximum swollen film thickness—film thickness)/film thickness.

The light-sensitive material of the present invention preferably comprises a hydrophilic colloidal layer (hereinafter referred to as "back layer") having a total dried thickness of 2 μm to 20 μm on the other side other than the emulsion layer side. The back layer preferably contains the above mentioned light absorbent, filter dye, ultraviolet absorbent, antistatic agent, film hardener, binder, plasticizer, lubricant, coating aid, surface active agent, etc. The back layer preferably exhibits a percentage swelling of 150 to 500%.

The present invention will be further described in the following examples, but the present invention should not be construed as being limited thereto.

EXAMPLE 1

A multi-layer color light-sensitive material was prepared as Specimen 101 by coating on an undercoated cellulose triacetate film support various layers having the following compositions:

(Composition of light-sensitive layer)

Materials to be incorporated in the various layers are classified into the following categories:

ExC: cyan coupler; ExM: magenta coupler; ExY: yellow coupler; ExS: sensitizing dye; UV: ultraviolet absorbent; HBS: high boiling organic solvent; H: gelatin hardener The figure accompanying each component indicates the coated amount thereof in g/m$^2$. The coated amount of silver halide is represented in g/m$^2$ as calculated in terms of silver. The coated amount of sensitizing dye is represented in the number of moles per mol of silver halide in the same layer.

| (Specimens 101) | |
|---|---|
| 1st layer: antihalation layer | |
| Black colloidal silver | 0.09 in silver equivalent |
| Gelatin | 1.30 |
| ExM-1 | 0.12 |
| ExF-1 | $2.0 \times 10^{-3}$ |
| Solid-dispersible dye ExF-2 | 0.030 |
| Solid-dispersible dye ExF-3 | 0.040 |
| HBS-1 | 0.15 |
| HBS-2 | 0.02 |
| 2nd layer: interlayer | |
| ExC-2 | 0.04 |
| Polyethyl acrylate latex | 0.20 |
| Gelatin | 1.04 |
| 3rd layer: low sensitivity red-sensitive emulsion layer | |
| Silver bromochloride emulsion A | 0.25 in silver equivalent |
| Silver bromochloride emulsion B | 0.25 in silver equivalent |
| ExS-1 | $6.9 \times 10^{-5}$ |
| ExS-2 | $1.8 \times 10^{-5}$ |
| ExS-3 | $3.1 \times 10^{-4}$ |
| ExC-1 | 0.17 |
| ExC-3 | 0.030 |
| ExC-4 | 0.10 |
| ExC-5 | 0.020 |
| ExC-6 | 0.010 |
| Cpd-2 | 0.025 |
| HBS-1 | 0.10 |
| Gelatin | 0.87 |
| 4th layer: middle sensitivity red-sensitive emulsion layer | |
| Silver bromochloride emulsion C | 0.70 in silver equivalent |
| ExS-1 | $3.5 \times 10^{-4}$ |
| ExS-2 | $1.6 \times 10^{-5}$ |
| ExS-3 | $5.1 \times 10^{-4}$ |
| ExC-1 | 0.13 |
| ExC-2 | 0.060 |

-continued (Specimens 101)

| | |
|---|---|
| ExC-3 | 0.0070 |
| ExC-4 | 0.090 |
| ExC-5 | 0.015 |
| ExC-6 | 0.0070 |
| Cpd-2 | 0.023 |
| HBS-1 | 0.10 |
| Gelatin | 0.75 |
| 5th layer: high sensitivity red-sensitive emulsion layer | |
| Silver bromochloride emulsion D | 1.40 in silver equivalent |
| ExS-1 | $2.4 \times 10^{-4}$ |
| ExS-2 | $1.0 \times 10^{-4}$ |
| ExS-3 | $3.4 \times 10^{-4}$ |
| ExC-1 | 0.10 |
| ExC-3 | 0.045 |
| ExC-6 | 0.020 |
| ExC-7 | 0.010 |
| Cpd-2 | 0.050 |
| HBS-1 | 0.22 |
| HBS-2 | 0.050 |
| Gelatin | 1.10 |
| 6th layer: interlayer | |
| Cpd-1 | 0.090 |
| Solid-dispersible dye ExF-4 | 0.030 |
| HBS-1 | 0.050 |
| Polyethyl acrylate latex | 0.15 |
| Gelatin | 1.10 |
| 7th layer: low sensitivity green-sensitive emulsion layer | |
| Silver bromochloride emulsion E | 0.15 in silver equivalent |
| Silver bromochloride emulsion F | 0.10 in silver equivalent |
| Silver bromochloride emulsion G | 0.10 in silver equivalent |
| ExS-4 | $3.0 \times 10^{-5}$ |
| ExS-5 | $2.1 \times 10^{-4}$ |
| ExS-6 | $8.0 \times 10^{-4}$ |
| ExM-2 | 0.33 |
| ExM-3 | 0.086 |
| ExY-1 | 0.015 |
| HBS-1 | 0.30 |
| HBS-3 | 0.010 |
| Gelatin | 0.73 |
| 8th layer: middle sensitivity green-sensitive emulsion layer | |
| Silver bromochloride emulsion H | 0.80 in silver equivalent |
| ExS-4 | $3.2 \times 10^{-5}$ |
| ExS-5 | $2.2 \times 10^{-4}$ |
| ExS-6 | $8.4 \times 10^{-4}$ |
| ExC-8 | 0.010 |
| ExM-2 | 0.10 |
| ExM-3 | 0.025 |
| ExY-1 | 0.018 |
| ExY-4 | 0.010 |
| ExY-5 | 0.040 |
| HBS-1 | 0.13 |
| HBS-3 | $4.0 \times 10^{-3}$ |
| Gelatin | 0.88 |
| 9th layer: high sensitivity green-sensitive emulsion layer | |
| Emulsion I | 1.25 in silver equivalent |
| ExS-4 | $3.7 \times 10^{-5}$ |
| ExS-5 | $8.1 \times 10^{-5}$ |
| ExS-6 | $3.2 \times 10^{-4}$ |
| ExC-1 | 0.010 |
| ExM-1 | 0.020 |
| ExM-4 | 0.025 |

-continued (Specimens 101)

| | |
|---|---|
| ExM-5 | 0.040 |
| Cpd-3 | 0.040 |
| HBS-1 | 0.25 |
| Polyethyl acrylate latex | 0.15 |
| Gelatin | 1.00 |
| 10th layer: yellow filter layer | |
| Yellow colloidal silver | 0.015 in silver equivalent |
| Cpd-1 | 0.16 |
| Solid-dispersible dye ExF-5 | 0.060 |
| Solid-dispersible dye ExF-6 | 0.060 |
| Oil-soluble dye ExF-7 | 0.010 |
| HBS-1 | 0.60 |
| Gelatin | 0.70 |
| 11th layer: low sensitivity blue-sensitive emulsion layer | |
| Silver bromochloride emulsion J | 0.09 in silver equivalent |
| Silver bromochloride emulsion K | 0.09 in silver equivalent |
| ExS-7 | $8.6 \times 10^{-4}$ |
| ExC-8 | $7.0 \times 10^{-3}$ |
| ExY-1 | 0.050 |
| ExY-2 | 0.73 |
| ExY-4 | 0.020 |
| Cpd-2 | 0.10 |
| Cpd-3 | $4.0 \times 10^{-3}$ |
| HBS-1 | 0.32 |
| Gelatin | 1.20 |
| 12th layer: high sensitivity blue-sensitive emulsion layer | |
| Silver bromochloride emulsion L | 1.00 in silver equivalent |
| ExS-7 | $4.0 \times 10^{-4}$ |
| ExY-2 | 0.10 |
| ExY-3 | 0.10 |
| ExY-4 | 0.010 |
| Cpd-2 | 0.10 |
| Cpd-3 | $1.0 \times 10^{-3}$ |
| HBS-1 | 0.070 |
| Gelatin | 0.70 |
| 13th layer: 1st protective layer | |
| UV-1 | 0.19 |
| UV-2 | 0.075 |
| UV-3 | 0.065 |
| HBS-1 | $5.0 \times 10^{-2}$ |
| HBS-4 | $5.0 \times 10^{-2}$ |
| Gelatin | 1.2 |
| 14th layer: 2nd protective layer | |
| Silver chloride emulsion M | 0.10 in silver equivalent |
| H-1 | 0.40 |
| B-1 (diameter: 1.7 $\mu$m) | $5.0 \times 10^{-2}$ |
| B-2 (diameter: 1.7 $\mu$m) | 0.15 |
| B-3 | 0.05 |
| S-1 | 0.20 |
| Gelatin | 0.70 |

In order to improve the preservability, processability, pressure resistance, mildew resistance, bacteria resistance, antistatic properties, and coating properties of the material, W-1 to W-3, B-4 to B-6, F-1 to F-17, iron salt, lead salt, gold salt, platinum salt, iridium salt, and rhodium salt were properly incorporated in the various layers.

TABLE 2

| Emulsion | Grain form | Silver chloride content (mol %) | Silver bromide localized on grain surface (mol %) | Average grain diameter in sphere equivalent (μm) |
|---|---|---|---|---|
| A | Rectangular, parallelogram, tabular | 99.2 | 0.8 | 0.46 |
| B | Rectangular, parallelogram, tabular | 99.2 | 0.8 | 0.57 |
| C | Rectangular, parallelogram, tabular | 99.3 | 0.7 | 0.66 |
| D | Rectangular, parallelogram, tabular | 99.5 | 0.5 | 0.84 |
| E | Rectangular, parallelogram, tabular | 99.2 | 0.8 | 0.46 |
| F | Rectangular, parallelogram, tabular | 99.3 | 0.7 | 0.57 |
| G | Rectangular, parallelogram, tabular | 99.2 | 0.8 | 0.61 |
| H | Rectangular, parallelogram, tabular | 99.2 | 0.8 | 0.61 |
| I | Rectangular, parallelogram, tabular | 99.5 | 0.5 | 0.84 |
| J | Rectangular, parallelogram, tabular | 99.2 | 0.2 | 0.46 |
| K | Rectangular, parallelogram, tabular | 99.3 | 0.7 | 0.64 |
| L | Rectangular, parallelogram, tabular | 99.6 | 0.4 | 1.28 |
| L | Cubic | 100.0 | 0.0 | 0.07 |

| Emulsion | Average aspect ratio | Grain diameter in terms of projected area (μm) | Grain size distribution fluctuation coefficient (%) |
|---|---|---|---|
| A | 5.5 | 0.56 | 15 |
| B | 4.0 | 0.78 | 20 |
| C | 5.8 | 0.87 | 25 |
| D | 3.7 | 1.03 | 26 |
| E | 5.5 | 0.56 | 15 |
| F | 4.0 | 0.78 | 20 |
| G | 4.4 | 0.77 | 23 |
| H | 4.4 | 0.77 | 23 |
| I | 3.7 | 1.03 | 26 |
| J | 4.2 | 0.5 | 15 |
| K | 5.2 | 0.85 | 23 |
| L | 3.5 | 1.46 | 26 |
| M | 1.0 | — | 15 |

In Table 2, (1) Emulsions J to L were subjected to reduction sensitization with thiourea dioxide and thiosulfonic acid in accordance with an example in JP-A-2-191938;

(2) Emulsions A to I were subjected to gold sensitization, sulfur sensitization and selenium sensitization in the presence of the spectral sensitizing dye as set forth with reference to the various light-sensitive layers and sodium thiocyanate in accordance with an example in JP-A-3-237450; and (3) The preparation of tabular grains was conducted in accordance with Example 1 of U.S. Pat. No. 5,264,337 so that an emulsion of finely divided silver chloride grains was dislocated to obtain tabular grains having {100} planes.

Preparation of dispersion of organic solid-dispersible dye

ExF-2 as shown below was dispersed in the following manner. In some detail, 21.7 ml of water, 3 ml of a 5% aqueous solution of sodium p-octylphenoxyethoxyethoxyethanesulfonate, and 0.5 g of a 5% aqueous solution of p-octylphenoxypolyoxyethylene ether (polymerization degree: 10) were charged into a 700-ml pot mill. To the mixture were then added 5.0 g of ExF-2 and 500 ml of zirconium oxide beads (diameter: 1 mm). The content was then subjected to dispersion for 2 hours by means of a BO type oscillating ball mill available from Chuo Koki K. K. After dispersion, the content was withdrawn from the mill, and then added to 8 g of a 12.5% aqueous solution of gelatin. The beads were then removed by filtration to obtain a gelatin dispersion of dye. The finely divided dye grains had an average grain diameter of 0.44 μm.

Solid dispersions of ExF-3, ExF-4 and ExF-6 were obtained in the same manner as above. These solid dispersions comprised finely divided grains having an average grain diameter of 0.24 μm, 0.45 μm and 0.52 μm, respectively. ExF-5 was subjected to dispersion in accordance with a microprecipitation dispersion method as described in Example 1 of EP 549,489A. This dispersion comprised finely divided grains having an average grain size of 0.06 μm.

ExC-1

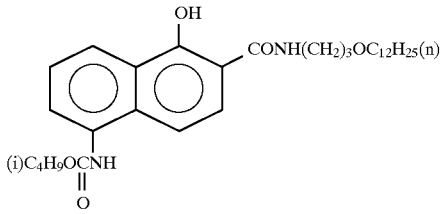

-continued
ExC-2
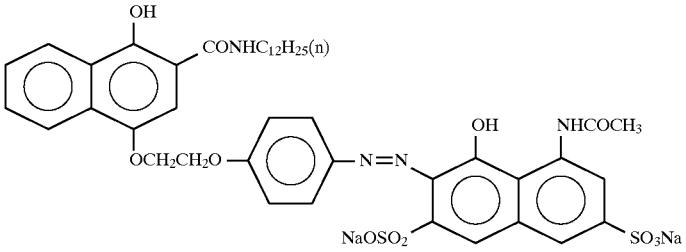
ExC-3
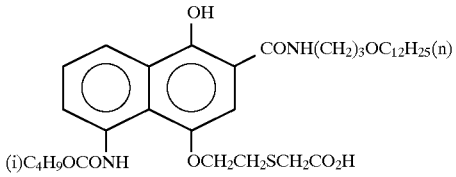
ExC-4
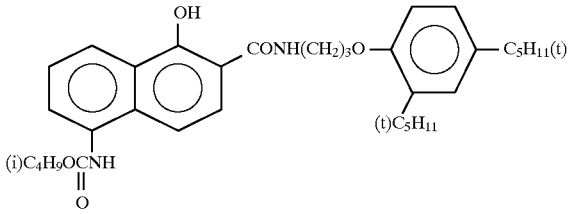
ExC-5
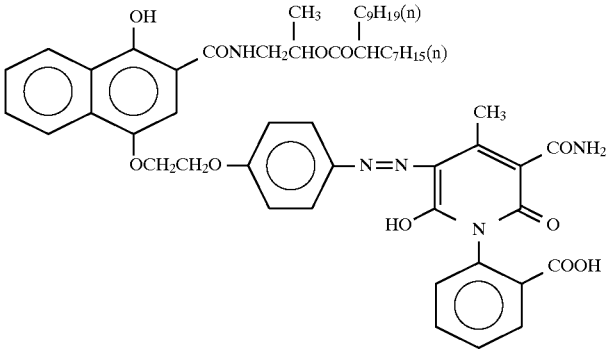
ExC-6
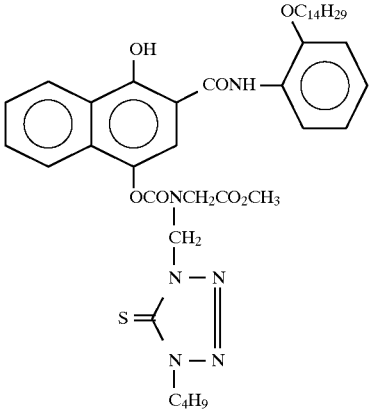
ExC-7
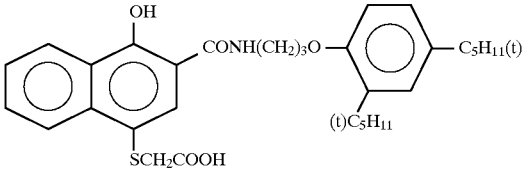

-continued
ExC-8
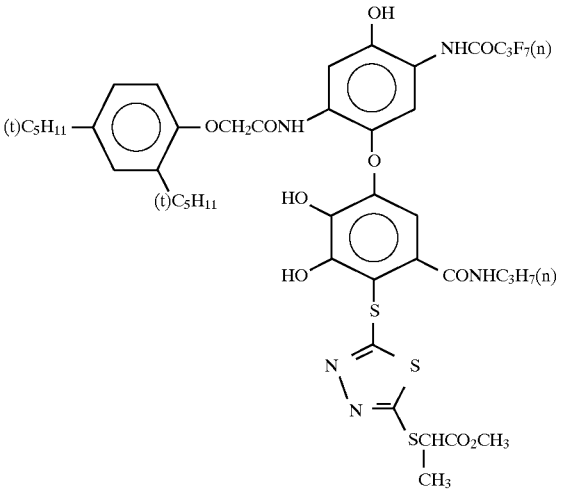
ExM-1
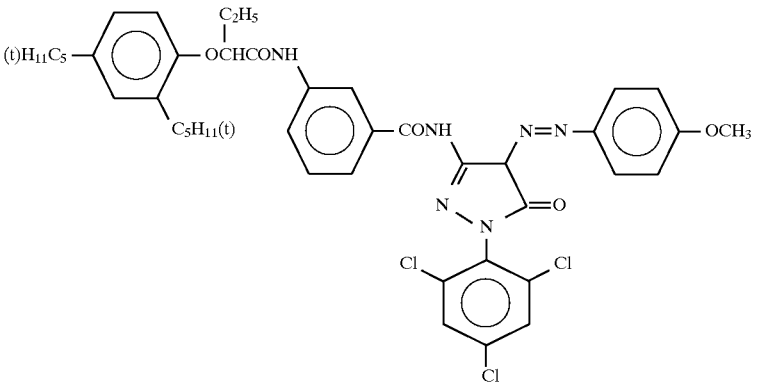
ExM-2
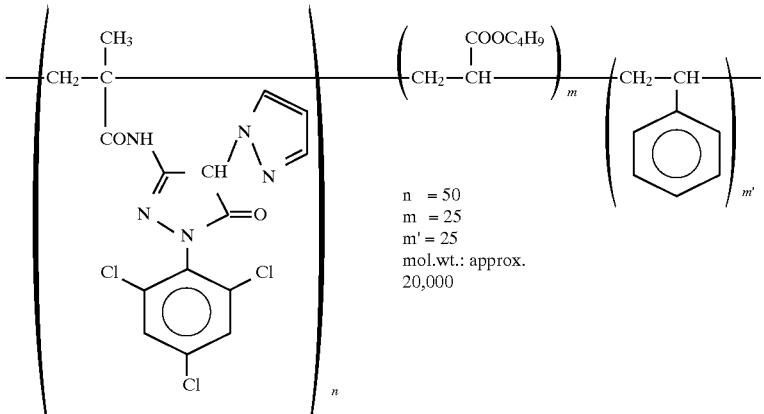
ExM-3
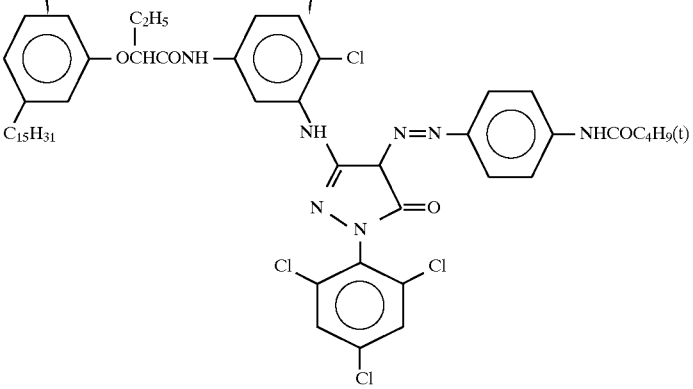

-continued
EXM-4
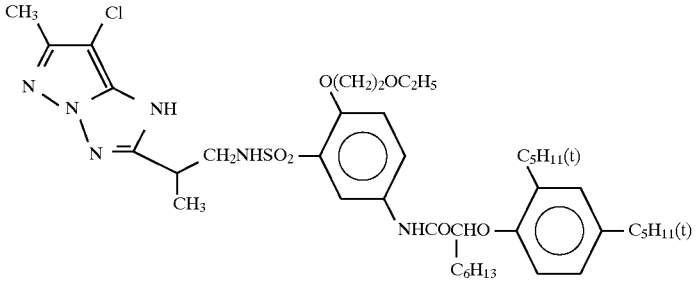
ExM-5
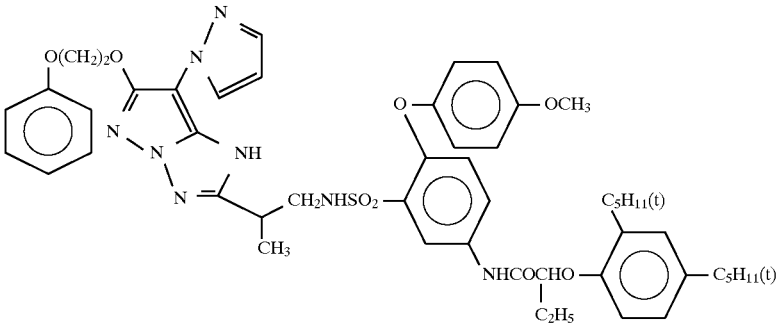
ExY-1
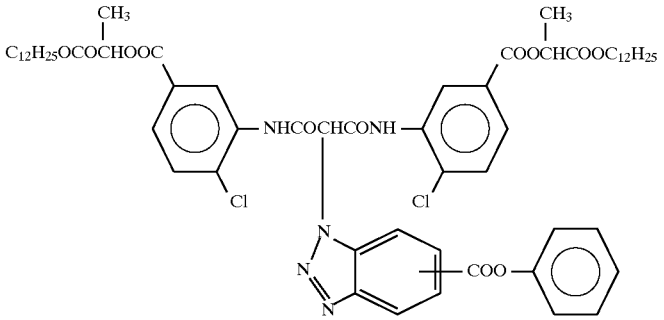
ExY-2
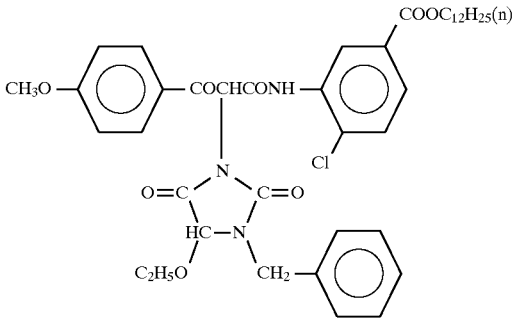
ExY-3
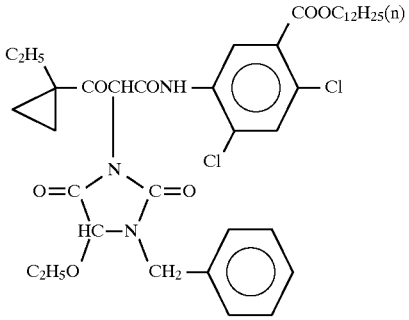

-continued
ExY-4
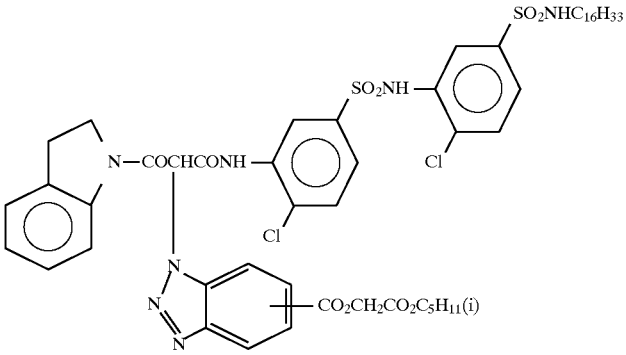
ExY-5
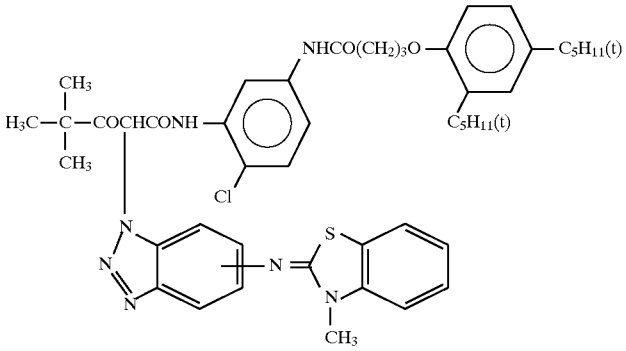
ExF-1
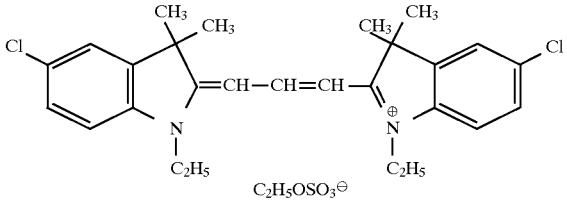
ExF-2
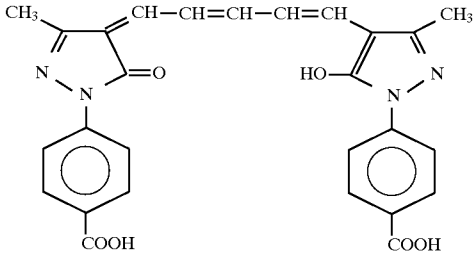
ExF-3
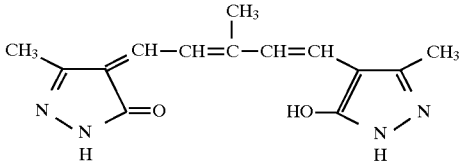
ExF-4
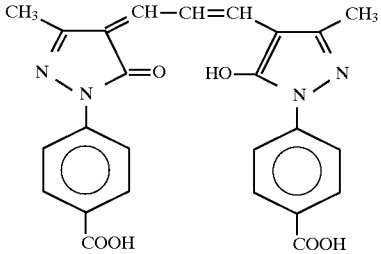

-continued
ExF-5
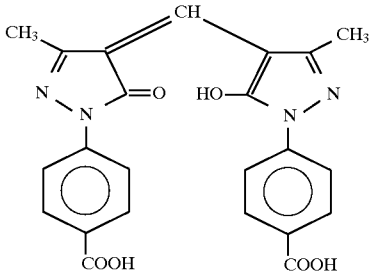
ExF-6
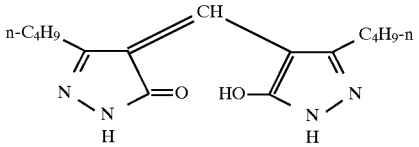
ExF-7
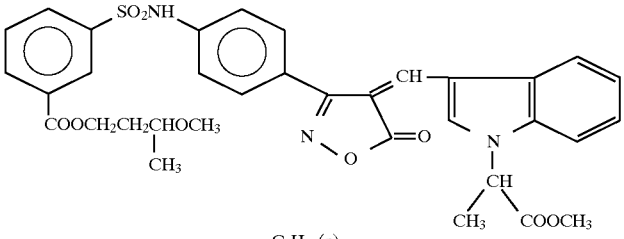
Cpd-1
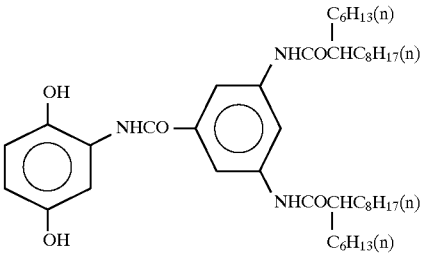
Cpd-2
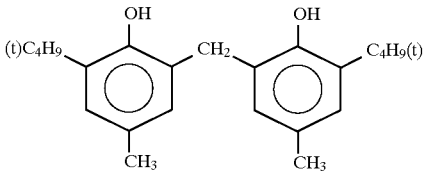
Cpd-3
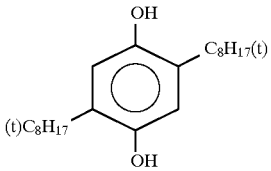
UV-1
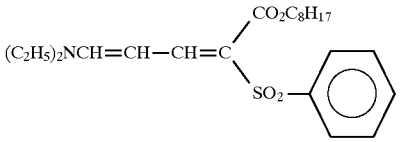
UV-2
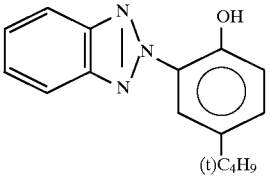

-continued
UV-3
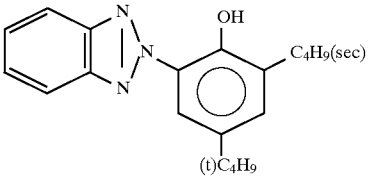
Tricresyl phosphate HBS-1
Di-n-butlyphthalate HBS-2
HBS-3
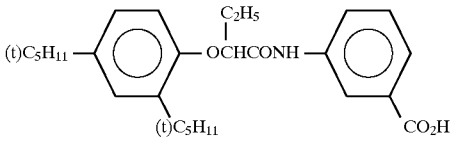
Tri(2-ethylhexyl)phosphate HBS-4
ExS-1
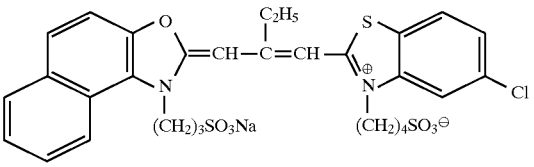
ExS-2
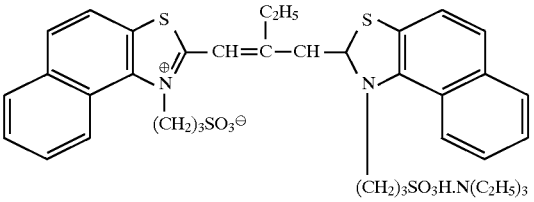
ExS-3
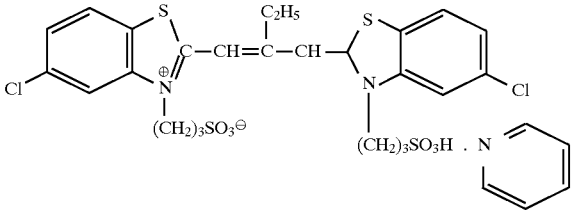
ExS-4
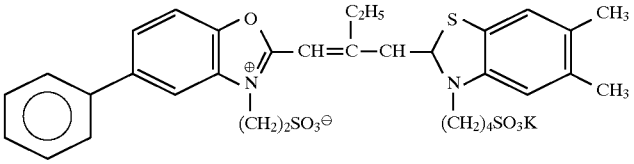
ExS-5
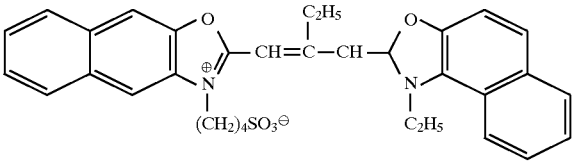
ExS-6
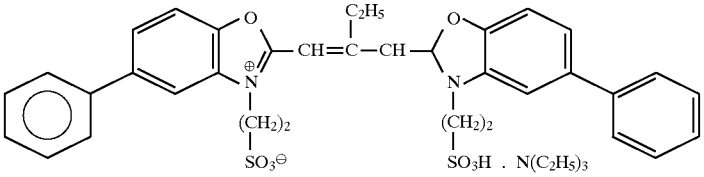

-continued
ExS-7
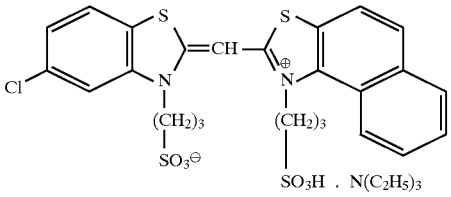
S-1
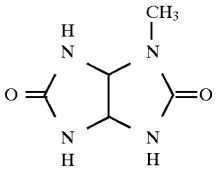
H-1
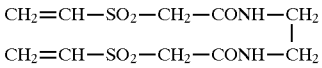
B-1
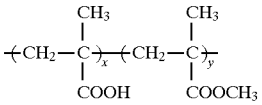
x/y = 10/90
B-2
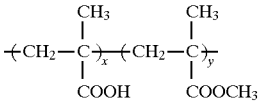
x/y = 40/60
B-3
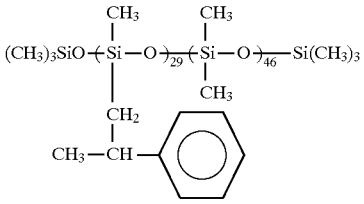
B-4
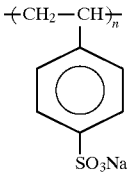
B-5
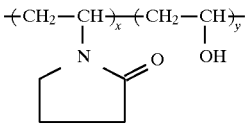
x/y = 70/30
B-6
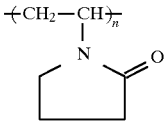
(mol. wt.:approx. 10,000)
W-1
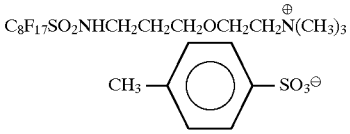
W-2
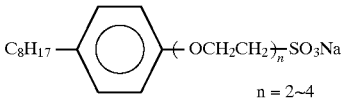
n = 2~4

-continued
W-3
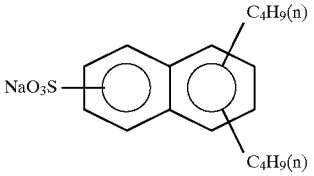
F-1
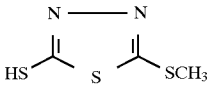
F-2
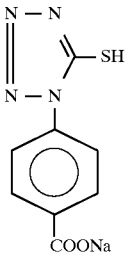
F-3
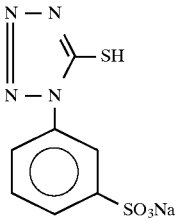
F-4
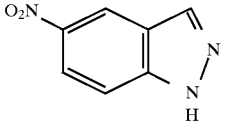
F-5
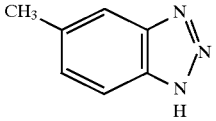
F-6
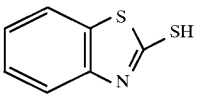
F-7
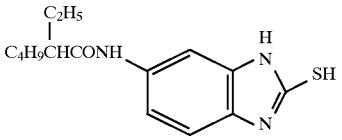
F-8
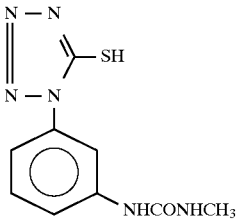
F-9
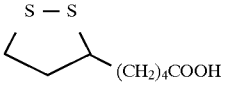

-continued

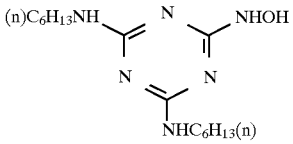

F-10

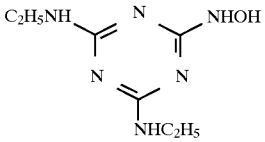

F-11

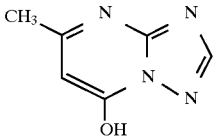

F-12

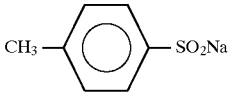

F-13

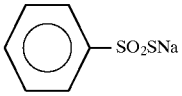

F-14

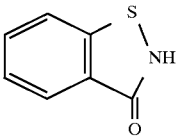

F-15

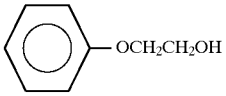

F-16

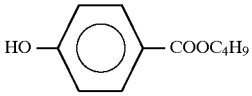

F-17

Thus, Specimen A was obtained.

Emulsions of high silver chloride content cubic grains having {100} planes were prepared in accordance with the emulsion preparation method of Specimen 304 in Example 3 of JP-A-64-6941. A specimen was prepared in the same manner as Specimen A except that Emulsions A to L were replaced by Emulsions A' to L', respectively. The emulsions used are set forth in Table 3.

TABLE 3

| Emulsion | Grain form | Silver chloride content (mol %) | Silver bromide localized on grain surface (mol %) | Average grain diameter in sphere equivalent (μm) | Coefficient of variation of grain size distribution (%) |
|---|---|---|---|---|---|
| A' | Cubic | 98.0 | 2.0 | 0.40 | 15 |
| B' | Cubic | 98.0 | 2.0 | 0.40 | 15 |
| C' | Cubic | 99.0 | 1.0 | 0.70 | 20 |
| D' | Cubic | 99.0 | 1.0 | 0.70 | 20 |
| E' | Cubic | 99.0 | 1.0 | 0.40 | 18 |
| F' | Cubic | 99.0 | 1.0 | 0.40 | 18 |
| G' | Cubic | 99.0 | 1.0 | 0.40 | 22 |
| H' | Cubic | 98.0 | 2.0 | 0.70 | 23 |

TABLE 3-continued

| Emulsion | Grain form | Silver chloride content (mol %) | Silver bromide localized on grain surface (mol %) | Average grain diameter in sphere equivalent (μm) | Coefficient of variation of grain size distribution (%) |
|---|---|---|---|---|---|
| I' | Cubic | 98.0 | 2.0 | 0.70 | 23 |
| J' | Cubic | 98.0 | 2.0 | 0.40 | 15 |
| K' | Cubic | 98.0 | 2.0 | 0.40 | 20 |
| L' | Cubic | 98.0 | 2.0 | 0.70 | 25 |
| M | Cubic | 100.0 | 0.0 | 0.07 | 15 |

Thus, Specimen B was obtained.

Emulsions of high silver chloride content octahedral grains having 111 planes were prepared in accordance with the emulsion preparation method in Example 5 of JP-A-63-212932. A specimen was prepared in the same manner as Specimen A except that Emulsions A to L were replaced by Emulsions A" to L", respectively. The emulsions used are set forth in Table 4.

TABLE 4

| Emulsion | Grain form | Silver chloride content (mol %) | Silver bromide localized on grain surface (mol %) | Average grain diameter in sphere equivalent (μm) | Coefficient of variation of grain size distribution (%) |
|---|---|---|---|---|---|
| A" | Octahedral | 100.0 | 0.0 | 0.40 | 12 |
| B" | Octahedral | 100.0 | 0.0 | 0.40 | 12 |
| C" | Octahedral | 100.0 | 0.0 | 0.71 | 11 |
| D" | Octahedral | 100.0 | 0.0 | 0.71 | 11 |
| E" | Octahedral | 100.0 | 0.0 | 0.38 | 10 |
| F" | Octahedral | 100.0 | 0.0 | 0.38 | 10 |
| G" | Octahedral | 100.0 | 0.0 | 0.38 | 10 |
| H" | Octahedral | 100.0 | 0.0 | 0.50 | 10 |
| I" | Octahedral | 100.0 | 0.0 | 0.66 | 10 |
| J" | Cubic | 100.0 | 0.0 | 0.43 | 14 |
| K" | Cubic | 100.0 | 0.0 | 0.43 | 14 |
| L" | Cubic | 100.0 | 0.0 | 0.70 | 10 |
| M" | Cubic | 100.0 | 0.0 | 0.07 | 15 |

Thus, Specimen C was obtained.

These specimens were each cut into 35-mm wide strips, wedgewise exposed to light at a color temperature of 4,800° K, and then processed with the following processing solutions in the following processing procedures by means of a processing machine for motion picture. The bleaching solutions were prepared each for Specimens A to C with different chelating agents as bleaching agents. These specimens were each processed in sequence. In the bleaching solutions, chelating agents were reacted with ferric nitrate nonahydrate to form a ferric complex salt of the chelating agents, respectively.

The processing steps will be described hereinafter.

| Processing Step | Processing time | Processing temperature |
|---|---|---|
| Color development | 1 min. 00 sec. | 40.0° C. |
| Bleach | 1 min. 00 sec. | 40.0° C. |
| Fixing | 1 min. 00 sec. | 40.0° C. |
| Rinse (1) | 30 sec. | 40.0° C. |
| Rinse (2) | 30 sec. | 40.0° C. |
| Stabilization | 30 sec. | 40.0° C. |
| Drying | 1 min. 00 sec. | 55.0° C. |

The various processing solution had the following compositions:

| Color developer | |
|---|---|
| Water | 800 ml |
| Potassium carbonate | 32.0 g |
| Sodium bicarbanate | 1.8 g |
| Sodium sulfite | 0.1 g |
| Potassium hydroxide | 1.7 g |
| Diethylenetriamine-pentaacetic acid | 1.2 g |
| 1-Hydroxyethy1idene-1,1-diphosphonic acid | 2.0 g |
| Potassium bromide | 0.01 g |
| Sodium chloride | 3.0 g |
| Diethylhydroxylamine | 4.0 g |
| 2-Methyl-4-(N-ethyl-N-β-hydroxylethylamino) aniline sulfate | 4.5 g |
| Water to make | 1,000 ml |
| pH | 10.05 |
| Bleaching solution | |
| Water | 700 ml |
| Chelating agent | 0.25 mol |
| Ferric nitrate (III) nonahydrate | 0.23 mol |
| Ammonium bromide | 1.0 mol |
| Ammonium nitrate | 0.2 mol |
| Acetic acid | 0.05 mol |
| Water to make | 1,000 ml |
| pH (adjusted with agueous ammonia, nitric acid) | 4.5 |
| Fixing solution | |
| Water | 700 ml |
| Disodium ethylenediaminetetraacetate | 1.7 g |
| Sodium sulfite | 20.0 g |
| 75 wt. % Ammonium thiosulfate | 220.0 g |
| Ammonium iodide | 0.9 g |
| Water to make | 1,000 ml |
| pH | 7.0 |
| Stabilizing solution | |
| Water | 900 ml |
| 1,4-Bis(1,2,4-triazole-1-ylmethyl) piperazine | 0.75 g |
| 1,2,4-Triazole | 1.3 g |
| Polyoxyethylene-p-monononylphenyl ether (average polymerization degree: 10) | 0.2 g |
| Disodium ethylenediaminetetraacetate | 0.05 g |
| Sodium p-toluenesulfinate | 0.03 g |
| 1,2-Benzoisothiazoline-3-one | 0.05 g |
| Water to make | 1,000 ml |
| pH | 8.5 |

The photographic light-sensitive material specimens thus processed were measured for amount of residual silver, bleach fog and yellow stain (silver sulfate) by the following methods:

Amount of residual silver

The amount of silver remaining in photographic light-sensitive material by X-ray fluoresence analysis.

Bleach fog

The photograpic light-sensitive material specimen which had been processed with the foregoing bleaching solutions measured for density. From the characteristic curve, Dmin measured with green light was read. ($D_G$min)

Yellow stain

The photographic light-sensitive material specimen which had been processed with the foregoing bleaching solutions were measured for density. From the characteristic curve, Dmin measured with green light was read. ($D_B$min)

TABLE 5

| Specimen No. | Chelating agent | Specimen A | | | Specimen B | | | Specimen C | | |
|---|---|---|---|---|---|---|---|---|---|---|
| | | Ag** | $D_{Gmin}$ | $D_{Bmin}$ | Ag | $D_{Gmin}$ | $D_{Bmin}$ | Ag | $D_{Gmin}$ | $D_{Bmin}$ |
| 1 | Ethylene-diamine-tetracetic acid | 13 | 0.60 | 0.85 | 15 | 0.62 | 0.86 | 14 | 0.63 | 0.86 |
| 2 | 1,3-Propane-diaminetetra-acetic acid | 2 | 0.93 | 0.98 | 2 | 0.95 | 1.00 | 2 | 0.96 | 1.01 |
| 3 | Iminodi-acetic acid | 8 | 0.75 | 1.05 | 9 | 0.78 | 1.10 | 10 | 0.80 | 1.11 |
| 4 | Diethylene-triamine-pentaacetic acid | 23 | 0.63 | 0.90 | 24 | 0.65 | 0.93 | 25 | 0.65 | 0.94 |
| 5 | I-1* | 4 | 0.61 | 0.85 | 13 | 0.68 | 0.94 | 15 | 0.70 | 0.95 |
| 6 | I-2 | 3 | 0.62 | 0.87 | 9 | 0.69 | 0.98 | 12 | 0.71 | 0.99 |
| 7 | I-4 | 3 | 0.60 | 0.87 | 14 | 0.70 | 0.95 | 17 | 0.73 | 0.98 |
| 8 | I-9 | 3 | 0.60 | 0.85 | 12 | 0.71 | 0.95 | 13 | 0.73 | 0.97 |
| 9 | II-1 | 4 | 0.62 | 0.86 | 8 | 0.71 | 0.94 | 10 | 0.73 | 0.97 |
| 10 | II-3 | 3 | 0.61 | 0.87 | 9 | 0.72 | 0.97 | 12 | 0.75 | 1.01 |
| 11 | II-7 | 3 | 0.61 | 0.86 | 10 | 0.72 | 0.98 | 12 | 0.75 | 1.02 |
| 12 | II-9 | 3 | 0.60 | 0.86 | 10 | 0.70 | 0.97 | 12 | 0.73 | 1.02 |

*Used in [S,S] form in a proportion of 100%
**Amount of Ag (unit: $\mu g/cm^2$)

Table 5 shows that when the photographic light-sensitive material specimen A of the present invention is processed with the bleaching solution Nos. 5 to 12 comprising bleaching agents of the present invention, it can be sufficiently desilvered and suffers from little bleach fog and yellow stain.

EXAMPLE 2

Specimens D, E and F were prepared in the same manner as Specimen A of Example 1 except that the coated amount of silver in the emulsion layers were altered as set forth in 6.

TABLE 6

(coated amount of silver: $g/m^2$)

| Layer | Grain form | Specimen A | Specimen D | Specimen E | Specimen F |
|---|---|---|---|---|---|
| 1st | Black colloidal silver | 0.09 | 0.09 | 0.09 | 0.09 |
| 3rd | Emulsion A | 0.25 | 0.35 | 0.40 | 0.40 |
| 3rd | Emulsion B | 0.25 | 0.35 | 0.40 | 0.40 |
| 4th | Emulsion C | 0.70 | 0.80 | 0.85 | 0.85 |
| 5th | Emulsion D | 1.40 | 1.50 | 1.55 | 1.55 |
| 7th | Emulsion E | 0.15 | 0.25 | 0.30 | 0.30 |
| 7th | Emulsion F | 0.10 | 0.20 | 0.25 | 0.25 |
| 7th | Emulsion G | 0.10 | 0.20 | 0.25 | 0.25 |
| 8th | Emulsion H | 0.80 | 0.90 | 0.95 | 0.95 |
| 9th | Emulsion I | 1.25 | 1.35 | 1.40 | 1.40 |
| 10th | Yellow colloidal silver | 0.015 | 0.015 | 0.015 | 0.015 |
| 11th | Emulsion J | 0.09 | 0.19 | 0.19 | 0.29 |
| 11th | Emulsion K | 0.09 | 0.19 | 0.19 | 0.29 |
| 12th | Emulsion L | 1.00 | 1.10 | 1.15 | 1.25 |
| 14th | Emulsion M | 0.10 | 0.20 | 0.20 | 0.30 |
| | Total | 6.385 | 7.685 | 8.185 | 8.585 |

These specimens were each cut into 35-mm wide strips, wedgewise exposed to light at a color temperature of 4,800° K., and then processed with the following processing solutions in the following processing procedures by means of a processing machine for motion picture. The bleaching solutions were prepared each for Specimens D to F with different chelating agents as bleaching agents as set forth in Tables 7 and 8. These specimens were each processed in sequence. In the bleaching solutions, chelating agents were reacted with ferric nitrate nonahydrate to form a ferric complex salt of the chelating agents, respectively.

The processing steps will be described hereinafter.

| Processing Step | Processing time | Processing temperature |
|---|---|---|
| Color development | 1 min. 00 sec. | 42.0° C. |
| Blix | 1 min. 00 sec. | 40.0° C. |
| Stabilization (1) | 20 sec. | 40.0° C. |
| Stabilization (2) | 20 sec. | 40.0° C. |
| Stabilization (3) | 20 sec. | 40.0° C. |
| Drying | 30 sec. | 70.0° C. |

The stabilization step was effected in a countercurrent process wherein the processing solution flows backward.

The various processing solution had the following compositions:

| Color developer | |
|---|---|
| Water | 800 ml |
| Potassium carbonate | 32.0 g |
| Sodium bicarbonate | 1.8 g |
| Sodium sulfite | 0.1 g |
| Potassium hydroxide | 1.7 g |
| Diethylenetriamine-pentaacetic acid | 3.0 g |
| Disodium 4,5-Dihydroxybenzene-1,3-disulfonate | 0.5 g |
| Potassium bromide | 0.01 g |
| Sodium chloride | 8.0 g |
| Disodium-N,N-bis(sulfonatoethyl) hydroxylamine | 6.0 g |

-continued

| | |
|---|---|
| 2-Methyl-4-(N-ethyl-N-β-hydroxylethylamino) aniline sulfate | 4.5 g |
| Water to make | 1,000 ml |
| pH | 10.10 |
| Blix solution | |
| Water | 700 ml |
| Chelating agent | 0.20 mol |
| Ferric nitrate (III) nonahydrate | 0.18 mol |
| Ammonium bromide | 1.0 mol |
| Sodium sulfite | 20.0 g |
| 75 wt. % Ammonium thiosulfate | 200.0 g |
| Ammonium nitrate | 0.2 mol |
| Water to make | 1,000 ml |
| pH (adjusted with aqueous ammonia, nitric acid) | 5.5 |
| Stabilizing solution | |
| Water | 900 ml |
| 1,4-Bis(1,2,4-triazole-1-ylmethyl) piperazine | 0.75 g |
| 1,2,4-Triazole | 1.3 g |
| Polyoxyethylene-p-monononylphenyl ether (average polymerization degree: 10) | 0.2 g |
| Disodium ethylenediaminetetraacetate | 0.05 g |
| Sodium p-toluenesulfinate | 0.03 g |
| 1,2-Benzoisothiazoline-3-one | 0.05 g |
| Water to make | 1,000 ml |
| pH | 8.5 |

The photographic light-sensitive material specimens thus processed were measured for mount of residual silver, bleach fog and yellow stain (silver sulfate) in the same manner as in Example 1. The results are set forth in Tables 7 and 8 below.

TABLE 7

| Specimen No. | Chelating agent | Specimen A Ag** | $D_{Gmin}$ | $D_{Bmin}$ | Specimen D Ag | $D_{Gmin}$ | $D_{Bmin}$ | Specimen E Ag | $D_{Gmin}$ | $D_{Bmin}$ |
|---|---|---|---|---|---|---|---|---|---|---|
| 21 | Ethylene-diamine-tetracetic acid | 18 | 0.60 | 0.85 | 19 | 0.61 | 0.87 | 23 | 0.61 | 0.89 |
| 22 | Diethylene-triamine-pentaacetic acid | 29 | 0.63 | 0.88 | 33 | 0.64 | 0.91 | 35 | 0.66 | 0.93 |
| 23 | Iminodi-acetic acid | 43 | 0.73 | 1.08 | 45 | 0.75 | 1.13 | 48 | 0.76 | 1.18 |
| 24 | I-1* | 3 | 0.60 | 0.85 | 3 | 0.60 | 0.85 | 7 | 0.63 | 0.87 |
| 25 | I-2 | 3 | 0.61 | 0.85 | 3 | 0.61 | 0.86 | 7 | 0.63 | 0.87 |
| 26 | II-3 | 3 | 0.61 | 0.87 | 3 | 0.61 | 0.87 | 7 | 0.63 | 0.89 |

TABLE 8

| Specimen No. | Chelating agent | Specimen F Ag** | $D_{Gmin}$ | $D_{Bmin}$ |
|---|---|---|---|---|
| 21 | Ethylene-diamine-tetracetic acid | 25 | 0.62 | 0.91 |
| 22 | Diethylene-triamine-pentaacetic acid | 38 | 0.68 | 0.96 |
| 23 | Iminod i-acetic acid | 51 | 0.77 | 1.21 |

TABLE 8-continued

| Specimen No. | Chelating agent | Specimen F Ag** | $D_{Gmin}$ | $D_{Bmin}$ |
|---|---|---|---|---|
| 24 | I-1* | 8 | 0.63 | 0.87 |
| 25 | I-2 | 8 | 0.63 | 0.87 |
| 26 | II-3 | 8 | 0.63 | 0.89 |

*Used in [S,S] form in a proportion of 100%
**Amount of Ag (unit: $\mu g/cm^2$)

Tables 7 and 8 show that when the photographic light-sensitive material specimens A, D, E and F of the present invention are processed with the bleaching solution Nos. 24 to 26 comprising bleaching agents of the present invention, it can be sufficiently desilvered and suffers from little bleach fog and yellow stain. These effects are remarkable particularly with Specimens A and D comprising silver in a coated amount of not more than 8 $g/m^2$.

EXAMPLE 3

The specimens of Example 2 were processed in the same manner as in Example 2 except that the stabilizing solution was free of 1,4-bis(1,2,4-triazole-1-ylmethyl)piperazine and 1,2,4-triazole. As a result, the same effects as shown in Example 2 were confirmed.

In accordance with the present invention, photographic light-sensitive materials can be sufficiently desilvered and thus provide an image having reduced bleach fog of magenta and reduced yellow stain.

While the invention has been described in detail and with reference to specific embodiments thereof, it will be apparent to one skilled in the art that various changes and modifications can be made therein without departing from the spirit and scope thereof.

What is claimed is:

1. A process for the processing of an exposed silver halide color photographic material comprising at least one silver halide emulsion layer on a support which comprises subjecting the silver halide color photographic material to color development, and then processing the silver halide color photographic material with a processing solution having a bleaching capacity, wherein said emulsion layer comprises tabular silver halide grains having {100} major faces, the tabular silver halide {100} grains having a silver chloride content of 50 to 100 mol % based on the total silver halide amount in said tabular silver halide grains, and said processing solution having a bleaching capacity contains at least one ferric complex salt of a compound represented by the following general formula (I):

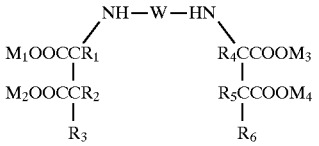

(I)

wherein $R_1$, $R_2$, $R_3$, $R_4$, $R_5$ and $R_6$ each represent a hydrogen atom, an aliphatic group, an aromatic group or a hydroxyl group; and W represents a divalent bridging group containing carbon atoms; and $M_1$, $M_2$, $M_3$ and $M_4$ each represent a hydrogen atom or cation, wherein the compound represented by the general formula (I) comprises an [S,S] form determined about the carbon atom to which $R_1$ and $R_4$ are attached in a proportion of not less than 70%.

2. A process for the processing of a silver halide color photographic material as claimed in claim 1, wherein the total coated amount of silver in said silver halide color photographic material is in the range of 2.0 to 8.0 g per $m^2$ of the silver halide color photographic material.

3. A process for the processing of a silver halide color photographic material as claimed in claim 1, wherein the tabular silver halide grains are subjected to sensitization with gold and sulfur in the presence of a cyanine dye.

4. A process for the processing of a silver halide color photographic material as claimed in claim 1, wherein the processing solution having a bleaching capacity contains a ferric complex salt-forming compound or compounds, including at least one compound represented by the general formula (I) in a proportion of not less than 50 mol % based on the total amount of ferric complex salt-forming compounds.

5. A process for the processing of a silver halide color photographic material as claimed in claim 1, wherein the silver halide grains are subjected to sensitization with a cyanine dye.

6. A process for the processing of a silver halide color photographic material as claimed in claim 1, wherein the silver halide grains are subjected to sensitization with gold and sulfur.

7. A process for the processing of a silver halide color photographic material as claimed in claim 1, wherein the processing solution having a bleaching capacity contains the ferric complex in an amount of 0.005 to 1.0 mol/l.

8. A process for the processing of a silver halide color photographic material as claimed in claim 1, wherein the tabular silver halide grains have a silver chloride content of 75 to 100 mol %.

9. A process for the processing of a silver halide color photographic material as claimed in claim 1, wherein the tabular silver halide grains having {100} major faces account for not less than 10% of the grains.

10. A process for the processing of a silver halide color photographic material as claimed in claim 1, wherein the tabular silver halide grains have an aspect ratio of not less than 1.5.

11. A process for the processing of a silver halide color photographic material as claimed in claim 1, wherein the silver halide emulsion has a monodisperse grain size distribution, and the coefficient of variation of the grain size distribution of the tabular grains is not more than 40%.

12. A process for the processing of a silver halide color photographic material as claimed in claim 1, wherein the tabular silver halide grains have a silver salt present on the surface thereof having lower solubility in water than silver chloride.

13. A process for the processing of a silver halide color Photographic material as claimed in claim 1, wherein the tabular silver halide grains are formed in the presence of an agent for oxidizing silver.

14. A process for the processing of a silver halide color photographic material as claimed in claim 1, wherein the silver halide grains are subjected to sensitization with selenium or tellurium.

* * * * *